US007762343B2

(12) United States Patent
Sonneveld et al.

(10) Patent No.: US 7,762,343 B2
(45) Date of Patent: Jul. 27, 2010

(54) APPARATUS AND METHOD FOR HANDLING PIPE

(75) Inventors: Leendert Adriaan Marinus Sonneveld, Hoeven (NL); Antonius Dimphena Maria Krijnen, SJ Klundert (NL); Albert Patrick Jozef Maria de Pont, MS Dongen (NL); Michael Antoon Herman Schats, PB Eindhoven (NL); Cornelis Wilhelmus Jacobus de Laat, DW Etten-Leur (NL); Johannes Wilhelmus Henricus van Rijzingen, DH Oosterhout (NL)

(73) Assignee: Varco I/P, Inc., Houston, TX (US)

( * ) Notice: Subject to any disclaimer, the term of this patent is extended or adjusted under 35 U.S.C. 154(b) by 1112 days.

(21) Appl. No.: 10/578,990

(22) PCT Filed: Aug. 16, 2004

(86) PCT No.: PCT/GB2004/050001

§ 371 (c)(1),
(2), (4) Date: May 11, 2006

(87) PCT Pub. No.: WO2005/106185

PCT Pub. Date: Nov. 10, 2005

(65) Prior Publication Data

US 2009/0252589 A1 Oct. 8, 2009

Related U.S. Application Data

(60) Provisional application No. 60/567,235, filed on May 1, 2004.

(51) Int. Cl.
*E21B 19/10* (2006.01)

(52) U.S. Cl. ..... 166/382; 294/102.1; 294/102.2; 175/423; 166/77.52

(58) Field of Classification Search ..... 294/102.2, 294/102.1; 166/77.52, 75.11, 77.51, 77.53, 166/85.1, 382; 175/423; 414/22.51–22.71
See application file for complete search history.

(56) References Cited

U.S. PATENT DOCUMENTS

| | | | | |
|---|---|---|---|---|
| 1,021,984 | A | 4/1912 | Holmes | 294/90 |
| 1,113,659 | A | 10/1914 | Lebus | 166/77.52 |
| 1,371,835 | A | 3/1921 | Angus | 294/90 |

(Continued)

OTHER PUBLICATIONS

Frank's Horseshoe Elevator: Frank's Casing Crew & Rental Tools: 1 page: 2001.

(Continued)

*Primary Examiner*—Shane Bomar
*Assistant Examiner*—Blake Michener
(74) *Attorney, Agent, or Firm*—Williams, Morgan & Amerson, P.C.

(57) ABSTRACT

An apparatus for handling pipes, the apparatus, in certain aspects, having a body having a tapered surface and at least a first slip and a second slip slidable on the tapered surface, a slip actuator for setting said at least first slip and said second slip, said first slip and said second slip having interengaging elements such that upon actuation of said slip actuator, said first slip is set and said second slip is set by the interengaging elements transferring setting force from the slip actuator through said first slip to said second slip; and methods for using such an apparatus.

15 Claims, 15 Drawing Sheets

U.S. PATENT DOCUMENTS

| | | | | | |
|---|---|---|---|---|---|
| 1,436,246 | A | * | 11/1922 | Greve | 175/423 |
| 1,448,100 | A | | 3/1923 | Wigle | |
| 1,598,709 | A | * | 9/1926 | Butler | 294/102.2 |
| 1,756,376 | A | | 4/1930 | Moore | |
| 1,779,895 | A | | 10/1930 | White | |
| 1,795,578 | A | * | 3/1931 | Smith | 188/67 |
| 1,842,638 | A | | 1/1932 | Wigle | |
| 1,844,379 | A | | 2/1932 | Campbell | |
| 2,048,208 | A | * | 7/1936 | Young et al. | 294/90 |
| 2,109,493 | A | * | 3/1938 | Lundeen | 188/67 |
| 3,140,523 | A | | 7/1964 | Taylor, Jr. | |
| 3,193,116 | A | | 7/1965 | Kenneday et al. | |
| 3,287,776 | A | | 11/1966 | Brown | 294/90 X |
| 3,330,354 | A | | 7/1967 | Chamblee | 166/313 |
| 3,358,341 | A | * | 12/1967 | Burstall | 294/102.2 |
| 3,403,791 | A | | 10/1968 | Marks et al. | |
| 3,461,666 | A | | 8/1969 | Burstall | |
| 3,776,320 | A | * | 12/1973 | Brown | 173/213 |
| 3,915,244 | A | * | 10/1975 | Brown | 175/85 |
| 3,996,737 | A | | 12/1976 | Burstall | 59/35 R |
| 4,126,348 | A | | 11/1978 | Palmer | 294/88 |
| 4,275,487 | A | * | 6/1981 | Gray et al. | 188/67 |
| 4,354,706 | A | | 10/1982 | Coyle, Sr. | 294/102 A |
| 4,415,193 | A | | 11/1983 | Carlberg | 294/102 A |
| 4,576,254 | A | * | 3/1986 | Cox | 188/67 |
| 4,834,441 | A | | 5/1989 | Schivley | 294/90 |
| 4,976,482 | A | * | 12/1990 | Wilhelmus van Steijn | 294/102.1 |
| 5,755,289 | A | | 5/1998 | Angman et al. | 166/378 |
| 5,794,314 | A | | 8/1998 | Gamper et al. | 24/517 |
| 5,848,647 | A | | 12/1998 | Webre et al. | 166/379 |
| 5,992,801 | A | | 11/1999 | Torres | 248/49 |
| 6,073,699 | A | | 6/2000 | Hollingsworth, Jr. | 166/379 |
| 6,227,587 | B1 | | 5/2001 | Terral | 294/102.2 |
| 6,279,662 | B1 | | 8/2001 | Sonnier | 166/380 |
| 6,305,649 | B1 | | 10/2001 | Walmsley et al. | 248/49 |
| 6,450,385 | B1 | * | 9/2002 | Guerin | 226/89 |
| 6,494,273 | B1 | | 12/2002 | Martin | 175/220 |
| 6,520,709 | B1 | | 2/2003 | Mosing et al. | 403/305 |
| 6,536,520 | B1 | | 3/2003 | Snider et al. | 166/78.1 |
| 6,568,479 | B2 | | 5/2003 | Mosing et al. | 166/380 |
| 6,571,667 | B2 | | 6/2003 | Price et al. | 81/57.33 |
| 6,626,238 | B2 | | 9/2003 | Hooper | 166/66 |
| 6,684,737 | B1 | | 2/2004 | Schulze-Beckinghausen et al. | 81/57.33 |
| 6,968,895 | B2 | | 11/2005 | Mosing et al. | 166/77.52 |
| 6,994,176 | B2 | | 2/2006 | Shahin et al. | 175/423 |
| 7,032,678 | B2 | * | 4/2006 | Mosing et al. | 166/380 |
| 7,036,397 | B2 | | 5/2006 | Bangert | 81/57.5 |
| 7,681,649 | B2 | * | 3/2010 | Cerovsek | 166/382 |
| 2004/0211297 | A1 | | 10/2004 | Bangert | 81/57.15 |

OTHER PUBLICATIONS

Elevators; Varco: 1 page: Composite Catalog 1986-87; 1986.

Catalog 1978-79: Joy Petroleum Equipment: cover page & pp. 6. 55: 1978.

BJ 1986-87 Oil Field Products and Systems: BJ Hughes Drilling Equipment: cover page, pp. 33, 34, 54, 55, 1986.

Varco General Catalog 2002: Varco L.P.: pp. 174, 175, 176: 2002.

Varco BJ PS 21/30 Power Slip improves both rig safety and efficiency: Varco BJ: 6 pages; 2003.

PS-16 Power Slip: Varco BJ Oil Tools: 2 pages; May 1992.

* cited by examiner

APPARATUS AND METHOD FOR HANDLING PIPE

CROSS-REFERENCE TO RELATED APPLICATIONS

This is a nationalization of PCT application Ser. No. PCT/GB 2004/050001 filed 16 Aug. 2004 (Int'l Publication No. WO 2005/106185, published 10 Nov. 2005) which claims priority from U.S. Application 60/567,235 filed 1 May 2004—both of which applications are incorporated fully herein for all purposes and from both of which the present invention and application claim priority under the Patent Laws.

BACKGROUND OF THE INVENTION

1. Field of the Invention

The present invention relates to an apparatus and method for facilitating handling pipe and handling pipe strings particularly, but not exclusively, to an elevator for handling pipe on drilling rigs. The pipe may be a single section, stand or string of drill pipe, a single section, stand or string of casing, tubular, premium tubular, drill collars or pipe incorporating a well tool.

2. Description of Related Art

In the drilling, completion and work over of a borehole in the oil, gas, water and geothermal industries pipes are run into and out of a borehole. Such an operation is sometimes referred to as "tripping in" for moving pipes down into a borehole and "tripping out" for moving pipes up and out of a borehole. Each of these operations requires pipes to be moved around a drilling rig. Accordingly, there are many problems associated with the handling and logistics of pipe handling of a drilling rig especially in the interconnecting, disconnecting, and storing of pipes on an oil drilling platform without interrupting the drilling process.

The types of pipes which need to be moved around a drilling rig comprise drill pipes, drill collars, casings, tubing, perforated tubing, liners, liner hanger tools, packers, well cleaning tools etc.

During a drilling operation on a conventional oil drilling platform, when the drill bit has penetrated such a distance into a borehole that only a small part of the drill string extends upwards from the upper surface of the drill floor, the drilling operation is stopped, and a new tubular drill string section is moved from a storage site or rack positioned outside the drill floor and connected to the upper end of the drill string. Once the new section is connected, the drilling operation may be continued. Normally, the length of the drill string sections is 30 feet or about 9 m (or a double or triple multiple thereof). Each time the drill bit has penetrated further into the underground, the drilling operation is usually stopped and a further drill string section (or stand) is added.

Many prior art drilling systems have a rotary drive, and/or a top drive, a supportive rig floor, a derrick extending vertically above said rig floor, and a travelling block which can be raised and lowered within the derrick. During drilling operations, such rig equipment is often used to insert and, in some cases remove, tubular goods from a well. Drill bits and/or other equipment are frequently lowered into a well and manipulated within a tubular drill pipe. Once a well has been drilled to a desired depth, large diameter pipe called casing is often installed in the wellbore and cemented in place in order to provide structural integrity to the well and to isolate down hole formations from one another.

Current systems for moving pipes on and around a drilling rig incorporate an elevator arranged on the end of a line hanging over a pulley wheel or travelling block hung from a derrick of the drilling rig or from bails of a top drive. The other end of the line is wound round a winch. The elevator generally comprises a pair of hinged semicircular segments, a latch and a safety mechanism to ensure the latch is closed properly. Such an elevator is sold by BJVarco under the trade name "BX Elevator"(™).

The pipe lies horizontally on a "catwalk" or on an inclined ramp or conveyor and is lifted manually clear of the surface on which it lies or the end of the pipe is exposed over a ledge. The segments of the elevator are closed about the body of the drill pipe and the latch is closed and the safety mechanism, usually a split pin is pushed into position to ensure the latch is properly closed and will not allow the latch to be opened until the split pin is removed. The elevator loosely fits around the body of the pipe such that the elevator can slide there along until the elevator abuts an upset in the pipe or a collar threaded to an end of the pipe. Drill pipe comprises an upset known as a "box" in which a female threaded end is located, alternatively an end of the pipe is threaded on to which is threaded a collar of larger outer diameter, which form a shoulder. The winch is activated to lift the elevator and the pipe hanging there from clear of the rig floor to facilitate movement of the pipe on and around the drilling rig. A roughneck is then able to swing the pipe to another location, usually for stabbing into a string of pipe already in the well or located in a mouse hole. One particular use is to facilitate movement of the drill pipe from the pipe storage areas to the well centre and the storage area close to the well centre known as the "fingerboard". This method is used in tripping-in operations. The elevator is then used to hold the entire weight of the pipe string whilst the slips in the platform, known as a spider, are released. The pipe string is rotated and lowered into the well and then the slips in the spider are engaged with the pipe and the elevator released.

The BJ Varco "BX hydraulically actuated elevator" is able to orient the throat of the elevator between a position to engage a vertical pipe to a position to engage a horizontal pipe and engaging a pipe lying at any angle therebetween. The elevator comprises segment in the form of hinged doors. The doors on a large elevator, which must be closed around the pipe, may weigh several hundred pounds. An elevator with doors needs clearance for the doors to swing in an arc under the pipe being engaged. The pipe has to be elevated, or clearance otherwise provided, for swinging doors.

Many prior art elevators are of a "non-slip" variety. The non-slip variety are especially suited to handle pipe which does not have an upset, although may also be used with pipes which have upsets. These pipes are known as "flush", "near flush" or "smooth walled" pipes. The non-slip elevator is provided with jaws with non-slip teeth move into engagement with the pipe, which prevents the pipe from slipping. Thus smooth walled pipe may be moved with such an elevator. The non-slip elevators have generally been constructed with doors (generally, one or two) which open to allow the insertion or removal of the pipe; doors which traditionally are heavy, slow in operation, difficult to handle and can present a considerable safety hazard to the operator. The balance point of such an elevator can change when the doors are open, thus creating handling problems and adding danger to the operator. Especially with very heavy pipes, for example, large casing, the pipe is initially in a horizontal position, laying in place on or near the floor beneath a derrick, and the hinged door elevator is lowered near the point of attachment to the pipe. The derrick personnel then are required to open the heavy door or doors, which may weigh several hundred pounds, to allow the elevator to be placed over the tubular. Because the door or doors must close around the tubular, the tubular end around which the elevator is located is often above the derrick floor.

Often there is idle time in which no actual drilling takes place. In view of the fact that the investment made in a drilling rig is very high even a relatively small reduction of the idle time is significant.

One solution commonly used to reduce the idle time on drilling rigs is to assemble two drill pipe sections, known as "singles", each having a length of about 10 m into a 20 m stand, known as a "double", placing the singles in a mouse hole adjacent to the drilling opening and connecting the singles by using air tuggers and spinning wrenches while the drilling operations proceeds.

One exemplary system and apparatus for such offline stand building is described in U.S. Pat. No. 4,850,439, the disclosure of which is incorporated herein by reference. However, although these conventional offline stand building systems do create significant efficiencies in the drilling process, they generally utilize many complex pieces of equipment, such as, hoists and multi-purpose pipe handling machines that result in a system which is complicated, costly, and requires significant ongoing maintenance.

Tubulars such as casing, drill pipe or other pipe are typically installed in a number of sections of roughly equal length. These pipe sections are typically installed one at a time, and screwed together or otherwise joined end-to-end to make a continuous length of pipe. In order to start the process of inserting pipe in a well, a first joint of pipe is lowered into the wellbore at the rig floor, and suspended in place using a set of "lower slips". Such lower slips are often wedge-shaped dies which can be inserted between the outer surface of said pie and the bowl-like inner profile of the rotary table. Such lower slips hold the weight of the pipe and suspend the pipe in the well. Although such lower slips can be automated, in many applications such lower slips are manually inserted and removed by rig personnel.

To install pipe into a well, a first joint of pipe is generally inserted into a well and positioned so that the top of said joint of pipe is located a few feet above the rig floor. A rig crew or a pipe handling machine grabs a second joint of pipe, lifts the second joint of pipe vertically into the derrick, positions the second joint above the first joint which was previously run into the well, and "stabs" a male threaded end, known as a "pin-end" at the bottom of said second joint into a female threaded end known as a "box-end" at the top of the first joint. The second joint is then rotated in order to mate the threaded connections of the two joints together. Then an elevator attached to the travelling block in the rig derrick is typically lowered over the top of the second (i.e., upper) joint of pipe. Such elevators have a central bore which is aligned with the uppermost end of the joint of pipe. The pipe is received within the central bore of the elevator. Once the elevator has been lowered over the pipe a desired distance, slips within such elevators can be activated to latch or grip around the outer surface of said joint pipe. Depending on the length of the second joint of pipe, this can often occur 12 m (40 feet) or more above the rig floor.

Upon proper latching and engagement of the elevator slips around the body of the pipe, the travelling block and elevator is raised to take weight off of the lower slips. The lower slips can then be removed. Once the lower slips are removed, the entire weight of the pipe string is suspended from the elevator slips. The pipe can then be lowered into the well by lowering the traveling block. After the second or upper joint of pipe is lowered a sufficient distance into the well, the lower slips are again inserted in place near the rig floor.

The process is repeated until the desired length of pipe (i.e., the desired number of joints of pipes) is inserted into the wellbore. This same process can be utilized for many different types and sizes of pipe whether small diameter drill pipe or large diameter casing. The entire weight of the pipe can be held or suspended by the elevators and by the elevator slips. This pipe can be very heavy, especially when many joints of large diameter and/or heavy-wall casing are being run into a well.

Accordingly, it is important that the elevator slips be properly latched around the uppermost section of pipe in the derrick to ensure that the pipe remains securely positioned within the elevators. If the pipe is not properly secured within the elevators, it is possible that the pipe drop or fall out of the elevators, causing damage to the rig or the well, or injury to rig personnel. Incorporated fully herein by reference are U.S. Pat. Nos. 6,626,238 B2; 6,073,699; 5,909,768; 5,84,647; 5,791,410; 4,676,312; 4,604,724; 4,269,554; 3,882,377; 6,494,273; 6,568,479; 6,536,520 B1; and 6,679,333 B2.

U.S. Pat. No. 6,073,699 discloses an elevator for lifting wellbore tubulars, the elevator having a pair of hinged doors, the doors interlocking with the use of a locking pin to prevent the elevator from opening.

BRIEF SUMMARY OF THE INVENTION

The inventors have recognized that it is advantageous to have a remotely operated slip type elevator; that hydraulic circuits are very controllable and reliable; that the elevator has to work with top drive systems; to be able to handle flush and near flush pipe safely; for a single elevator which, by replacing the slips with one of six sets of sips can handle pipes which range between 2⅜"-2⅞" for the first size set of slips, 2⅞"-3½" for the second size set of slips, 3½"-4½" for the third size set of slips, 4½"-5½" for the fourth size set of slips, 5⅝"-6⅝" for the fifth size set of slips and 6⅝"-7⅝" for the sixth size set of slips.

According to the present invention, there is provided an apparatus for handling pipes, the apparatus comprising a body having a tapered surface and at least a first slip and a second slip slidable on the tapered surface, the apparatus further comprising a slip actuator for setting the at least first slip and the second slip characterized in that the first slip and the second slip have interengaging elements therebetween such that upon actuation of the slip actuator, the first slip is set and the second slip is set by the interengaging elements transferring the setting force from the slip actuator through the first slip to the second slip.

A slip is any item which can be used to prevent or inhibit a pipe from falling through an aperture, such as the throat of an elevator. A slip is traditionally a wedge inserted between an outer body provided with a tapering surface and the outer wall of a pipe.

Traditionally the slip tapers, although a tapering outer surface is not essential, any arms or feet which provide a tapered interface would suffice. The taper allows easy removal of the slip, which would otherwise be very difficult. The taper allows the pipe engaging surface to move radially away from the pipe, as the pipe engaging surface is designed to resist longitudinal movement, mainly to inhibit downward slippage of a pipe or string of pipe, but also to inhibit a small amount of upward force. The slip may have a substantially planar pipe engaging surface or have concave and convex surfaces or have inserts with pipe engaging surfaces which are of varying depths which preferably conform to the outer wall of a pipe which will be held therein or the pipe engaging surface may be concave and provided with a plurality of inserts with pipe engaging surfaces. Preferably, the inserts are provided with gaps therebetween. By having a pipe engaging surface with a large contact area, the pipe engaging surface may be provided with smaller teeth or a less rough, less invasive surface, thus the outer wall of the pipe is less likely to be damaged. This is particularly important for pipes such as premium tubulars and pipes made from brittle alloys, carbon fiber and plastics pipes. However, a planar pipe engaging surfaces may suffice, particularly, but not exclusively, if the planar pipe engaging surface is provided with teeth which bite into the outer wall of the pipe.

Preferably, the interengaging elements comprise an upstand and a recess and most preferably the upstand of the first slip is freely slideable into and out of the recess so that the when the slips are removed from the elevator, the slips are free to part from one another.

Advantageously, the interengaging element of the first slip is in fixed relation to the first slip and the interengaging element of the second slip is in fixed relation to the second slip. Preferably, there are a plurality of interengaging up stands and recesses; the recess may be correspondingly shaped with the upstand, preferably to form an interference fit. The pin may be tapered and the recess may have a corresponding taper.

Preferably, the interengaging element of the first slip is integral with the first slip and the interengaging element of the second slip is integral with the second slip. The interengaging elements may comprise a series of interengaging teeth on each side of the slip.

Advantageously, the slip has a pipe engaging surface. The pipe engaging surface may be arranged on inserts which form part of the slip. The inserts may be arranged in grooves in the body of the slip.

Preferably, the first and second slips each has a pipe engaging surface, a top, a bottom, a rear face and two sides. Advantageously, the interengaging elements are located on or in at least one of the sides. Preferably, the rear face slides along the tapered surface of the body.

Advantageously, the slip actuator sets the at least first and second slips by moving the at least first and second slips down the tapered surface, wherein the interengaging elements allow lateral movement between the first and second slip. Preferably, the tapered surface takes the form of a frusto-conical surface. Thus by allowing freedom to move transverse to the direction of actuation of the slip along the frusto-conical tapered surface the slips can move apart on unsetting the slips and move together on setting the slips. Preferably, the body comprises a main body and at least one door, the tapered surface located on preferably both.

Advantageously, the frusto-conical surface is located on a main body and two doors. The body comprises the main-body and the doors. Thus the weight of the pipe string is carried through the doors as well as the main body.

Preferably, one of the doors comprises a latch and the other of the doors comprises a catch. Preferably, to ensure that the doors are not inadvertently opened or opened by mechanical shock. Advantageously, the main body subtends substantially one hundred and eighty degrees and each of the doors subtends between seventy-five and ninety degrees. Although the main body may subtend any angle, such as thirty degrees and the doors one hundred and sixty-five degrees each. Preferably, the first slip is located on the tapered surface of the main body and the second slip is located on the tapered surface of one of the doors.

The frusto-conical surface may taper from top to bottom along a straight path, or may have a slight convex or concave curvature. The complete frusto-conical surface is commonly referred to as a bowl.

Preferably, a third slip and a fourth slip slidable on the tapered surface, the apparatus further comprising a further slip actuator for setting the at least third slip and the fourth slip, wherein the third slip and the fourth slip have interengaging elements therebetween such that upon actuation of the slip actuator, the third slip is set and the fourth slip is set by the interengaging elements transferring the setting force from the slip actuator through the third slip to the fourth slip.

Alternatively, the first actuating mechanism acts solely on the first slip and sets three or four or more slips simultaneously by transferring the setting force from the first slip through interengaging means on the second third and fourth slips to set all of the slips simultaneously.

Advantageously, the slip actuator is hydraulically actuable. Most advantageously, the slip actuator and further slip actuator are actuable by a common hydraulic circuit, with a common supply of hydraulic fluid, and second preferably, the slip actuator may be, or may include a pneumatic, electrical, or mechanical means such as springs. The present invention also provides in or for use in the apparatus of the invention, a slip having interengaging elements. Preferably, the slip comprises a plurality of grooves, an insert arranged in each of the plurality of grooves. Advantageously, each insert has a pipe engaging surface. Preferably, the pipe engaging surface comprises at least one of the following: tungsten carbide particles, diamond particles, metallic teeth. Preferably, the slip has a pipe engaging surface, a top, a bottom, a rear face and two sides, the interengaging elements located on at least one of the sides.

The invention also provides a method for setting slips in an apparatus for handling pipes of the invention, the method comprising the steps of operating the slips actuating mechanism to apply a setting force to the first slip, whereupon the interengagement means transfers the setting force to the second slip, setting the first and second slips simultaneously.

According to a second aspect of the invention, there is provided an apparatus for handling pipes, the apparatus comprising a body with a tapered surface, a recess in the tapered surface and a pin arranged therein, the apparatus further comprising a slip slideable on the tapered surface, wherein the slip has a lug slideable on the pin, the slip biased by resilient means between the body and the lug to bias the slip into an unset position. Preferably, this allows easy replacement of the slip by withdrawing the pin. Preferably, apparatus further comprises a shoulder arranged in the path of action of the resilient means to inhibit clamping of the lug between the resilient means and the body and preferably defining an opening between the resilient means and the body which is slightly larger than the lug to facilitate easy replacement of the slip.

Once the pin is removed, and upon removal of the slip, the lug of the slip being removed does not cause the resilient means to uncoil or decompress or to lose stored energy. Advantageously, the apparatus further comprises a sleeve about a portion of the pin close to the lug, wherein the resilient means surrounds the sleeve. Advantageously, the sleeve is fixed to the shoulder. Preferably, the shoulder comprises a plate to lie above the resilient means and a leg upstanding from the plate. Advantageously, the body of the elevator further comprises a lug, the resilient means biased between the lug of the slip and the lug of the body of the elevator.

This preferably stabilizes the pin. Preferably, the slip comprises a further lug arranged below the further lug of the body of the elevator. Preferably, the body comprises a ledge against which the lug of the slip is biased. Advantageously, the resilient means comprises at least one of the following: pneumatic piston and cylinder, hydraulic piston and cylinder and an accumulator, a coiled spring, Belville washers, and resilient material such as a foam, but most preferably a compression spring.

The second aspect of the invention also provides a method of changing a slip in an apparatus for handling pipes using the apparatus of the second aspect of the invention, the method comprising the steps of removing the pin from the body 2 and moving the slip to slide the lug thereof out of the recess in the body of the apparatus.

According to a third aspect of the invention, there is provided a method for indicating slips of an elevator have engaged a pipe, the elevator having a slip actuator for actuating slips to engage a pipe, the slip actuator comprising a hydraulically operated piston and cylinder, the method comprising the steps of applying pressurized hydraulic fluid to the piston in the piston and cylinder to move the piston to move the slips into engagement with a pipe, the piston passing a signal port, upon which pressurized hydraulic fluid communicates with hydraulic fluid in a line connected to the signal port, which indicates to the controller that the slips are actuated. Preferably, the line returns to a console from which the controller can observe the increase in pressure using a display of a pressure gauge. Advantageously, the apparatus further comprises a pressure limiting valve, the method further comprising the step of passing the pressurized fluid in line through the pressure limiting valve. Preferably, the increase in pressure is in the order of between 20 bar to 200 bar, most preferably 60 to 150.

Advantageously, the elevator further comprises a door and a latch, the door operated by a hydraulic piston and cylinder, the piston and cylinder having a signal port, the method further comprising the step of applying hydraulic fluid under pressure to the piston and cylinder to move the piston to close the door, whereupon the piston passes the signal port, whereupon hydraulic fluid in a line connected to the signal port is pressurized to initiate activation of the latch. Preferably, the elevator further comprises a hydraulic switch, actuable upon the latch assuming a closed position, which switch allows hydraulic fluid under pressure to flow there through to initiate activation of the slips actuator.

According to a fourth aspect of the present invention, there is provided a method for handling pipe using an elevator having a hydraulic slip actuator for activating slips for engaging a pipe, wherein the elevator further comprises a pilot line, the method comprising the steps of applying pressurized hydraulic fluid to the pilot line to activate the slips actuator to disengage the slips. Preferably, operating the slips actuator to disengage the slips doesn't necessarily mean that the slips themselves will be disengaged. If the pipe is unsupported when the slips actuator is disengaged from the pipe, the weight of the pipe will continue to energise the slips and maintain the slips in the down position with the pipe engaged in the elevator.

The fourth aspect of the present invention also provides an apparatus for handling pipes, the apparatus comprising a body, at least one door and a hydraulic slip actuator for activating at least one slip characterized in that the apparatus further comprises a pilot line and a valve for directing flow of hydraulic fluid into the slip actuator to activate the slips actuator to disengage the slips. This allows the slips to be disengaged whilst the doors and latch remain engaged.

According to a fifth aspect of the present invention, there is provided an apparatus for handling pipes, the apparatus comprising an elevator having a body, at least one ear, and a slip actuator for engaging slips with a pipe said apparatus further comprising a stator attachable to bails of a top drive, the apparatus further comprising a rotor attached to said at least one ear and drive means for rotating said rotor for tilting said elevator with respect to the stator. Preferably, the elevator further comprises at least one door.

The fifth aspect of the present invention also provides a method for handling flush or near flush pipe using an elevator depending from bails of a top drive, the elevator having body and at least one door defining a throat, slips located in the throat and a slip actuator, the method comprising the steps of opening the at least one door of the elevator, tilting the elevator with respect to the bails, placing pipe in a throat of the elevator, closing the doors and activating slips to engage the pipe and hoisting the elevator which allows the elevator to assume its initial position with a pipe depending there from.

By near flush pipes is meant any pipe which does not have an upstand or collar of sufficiently larger diameter than the diameter of the body of the pipe to form an upset from which the pipe can hang when arranged in an elevator having a shoulder on which the upset rests, such as the elevator shown in U.S. Pat. No. 6,494,273.

Preferably, the elevator further comprises a hydraulically actuable piston and cylinder for facilitating opening the door, wherein the method further comprises the steps of opening the doors by raising hydraulic pressure in the actuator, the piston passing a signal port, whereupon a signal is sent which initiates a safety valve which allows the elevator to be tilted. Preferably, the piston and cylinders are double acting, the method further comprising the step of applying pressurized hydraulic fluid to the other side of the piston to disengage the slip actuator.

BRIEF DESCRIPTION OF THE SEVERAL VIEWS OF THE DRAWINGS

For a better understanding of the present invention, reference will now be made, by way of example, to the accompanying drawings, in which.

DETAILED DESCRIPTION OF THE INVENTION

Figure 14:
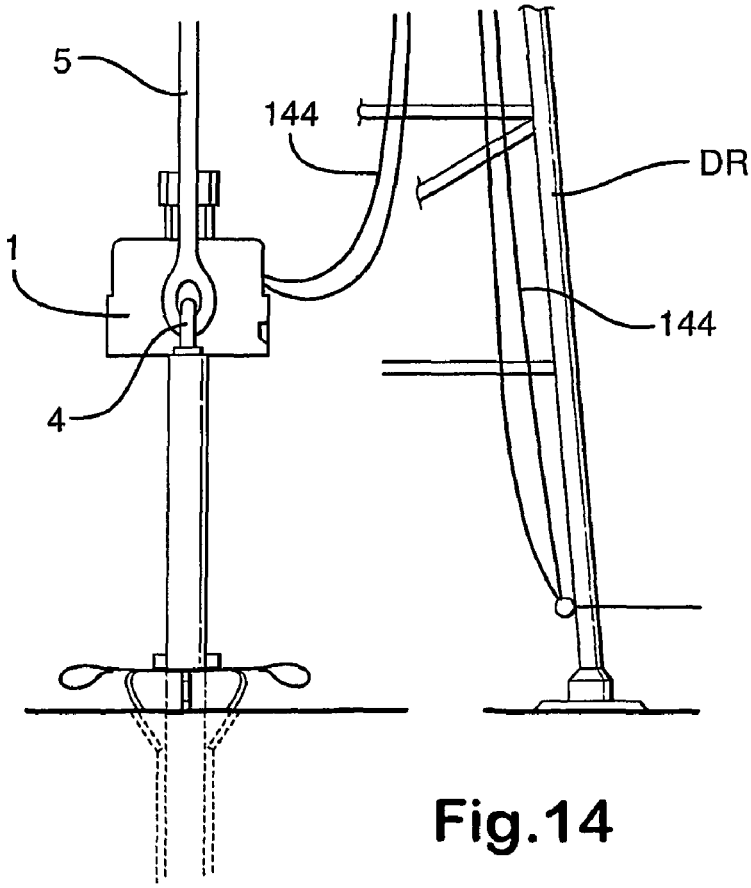
FIG. 14 is a schematic representation of part of a drilling rig, including the apparatus shown in FIG. 1 depending from bails.

Referring to FIGS. 1 to 13, there is shown an apparatus of the present invention generally identified by the reference numeral 1. In the art of handling pipes on a drilling rig, the apparatus 1 is often referred to as an "elevator". The elevator 1 comprises a part cylindrical body 2 having lifting ears 3 and 4 arranged on opposing sides of the housing 2 for connection to a pair of bails 5, as shown in FIG. 14. Doors 6 and 7 are hinged to the body 2 on hinge pins 8 and 9. A latch 10 is provided to latch the two doors 6 and 7 together to inhibit the doors 6 and 7 from inadvertent opening due to operational mechanical shocks.

Figure 1:
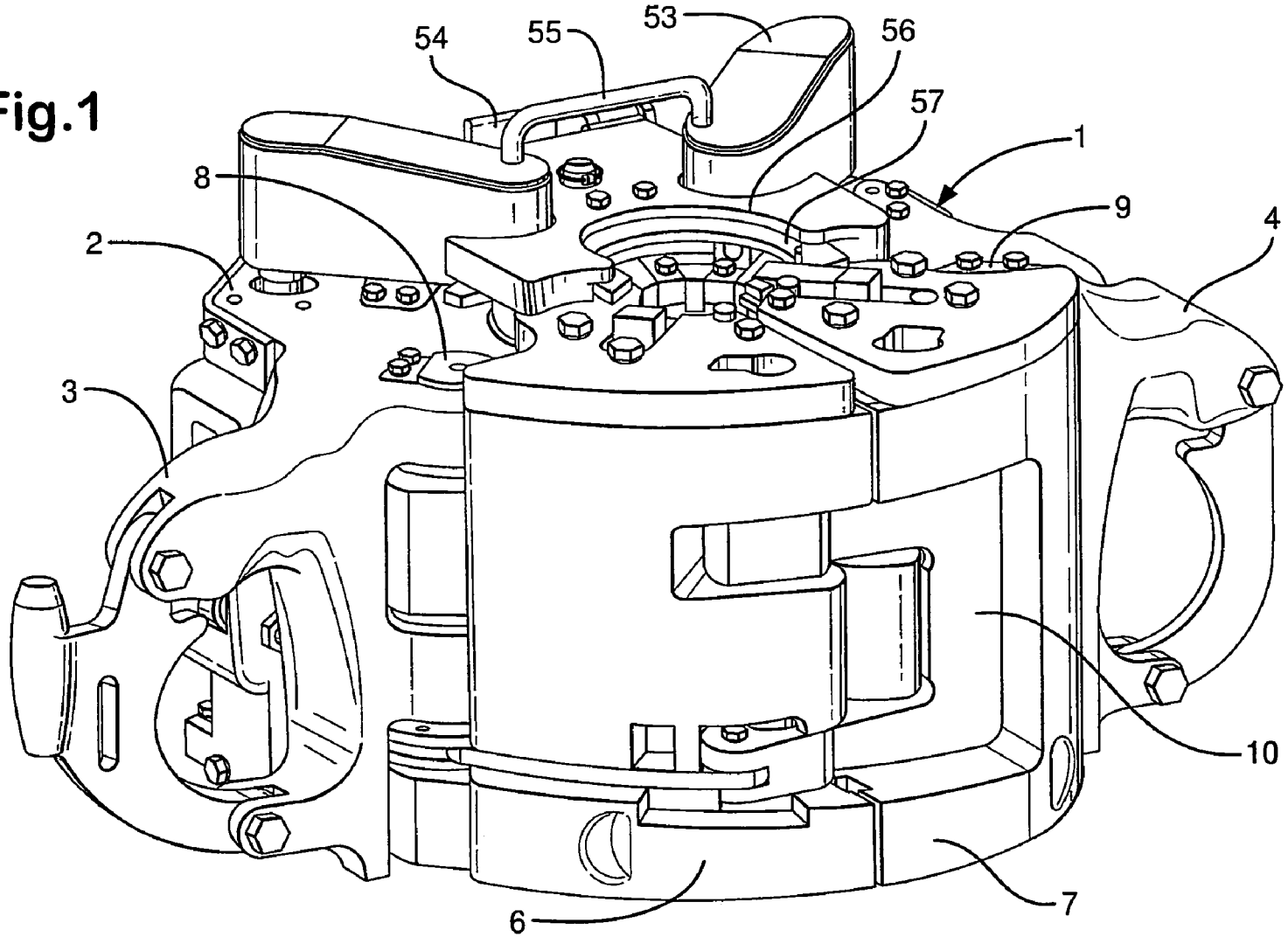
FIG. 1 is a perspective view of an apparatus in accordance with the present invention.
Figure 10:
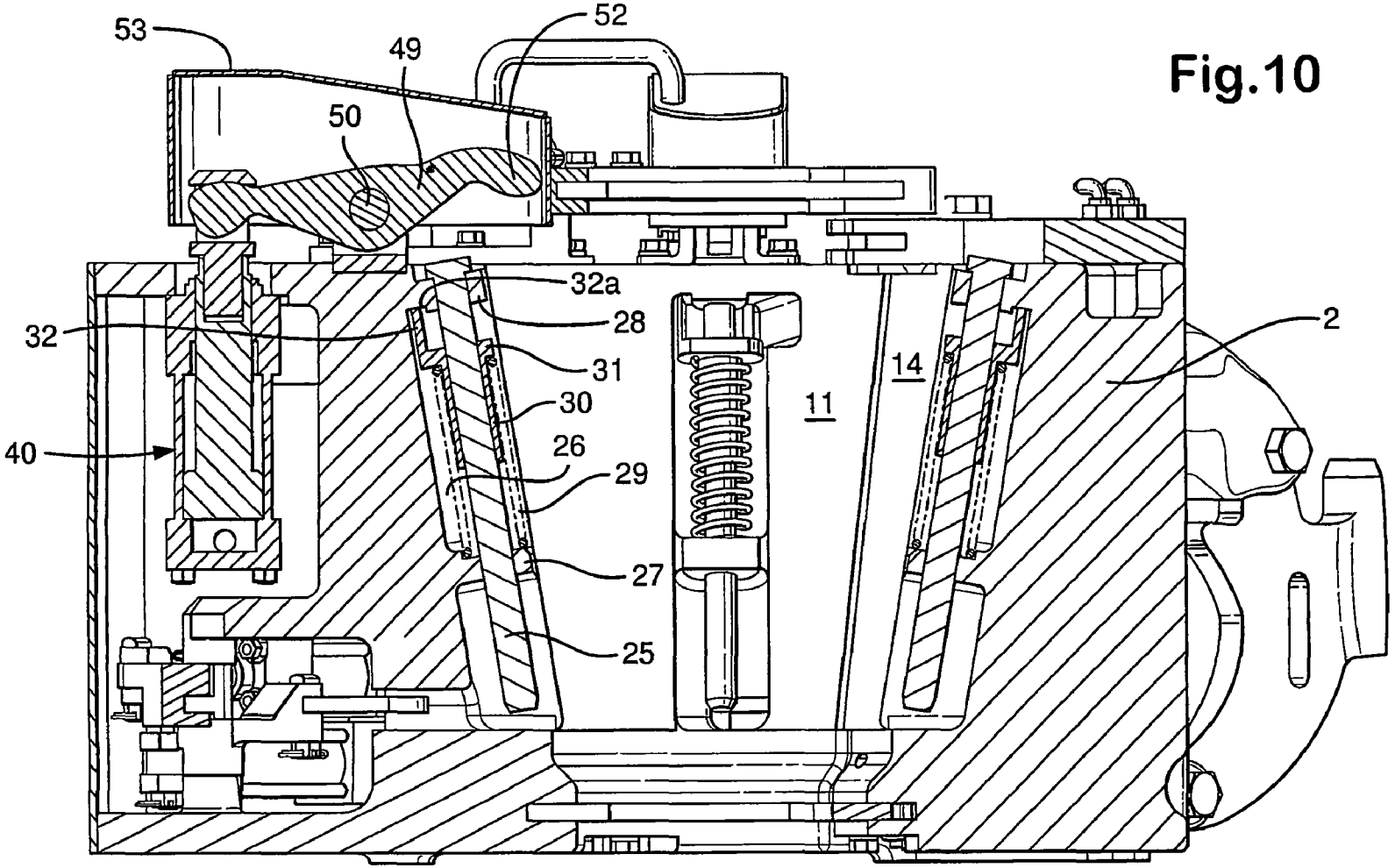
FIG. 10 is a simplified view, similar to the view shown in FIG. 9, with the slips removed.

The body 2 has a part frusto-conical inner surface 11 which tapers inwardly from the top to the bottom of the body 2 at an angle of approximately ten degrees from vertical to define an open throat 12, see FIGS. 1 and 10. From FIG. 7 it can be seen that the part frusto-conical inner surface 11 subtends approximately one hundred and eighty degrees. The doors 6 and 7 each have a part frusto-conical inner surface 13 and 14 which taper inwardly from the top to the bottom at an angle of approximately ten degrees from vertical. The part frusto-conical inner surface 13 and 14 each subtend slightly less than quarter of a circle, approximately eighty-four degrees. When the doors 6 and 7 are closed, a substantially complete frusto-conical surface is defined.

The complete frusto-conical surface may taper from top to bottom along a straight path, or may have a slight convex or concave curvature. The complete frusto-conical surface 11, 13 and 14 is commonly referred to as a "bowl".

Figure 2:
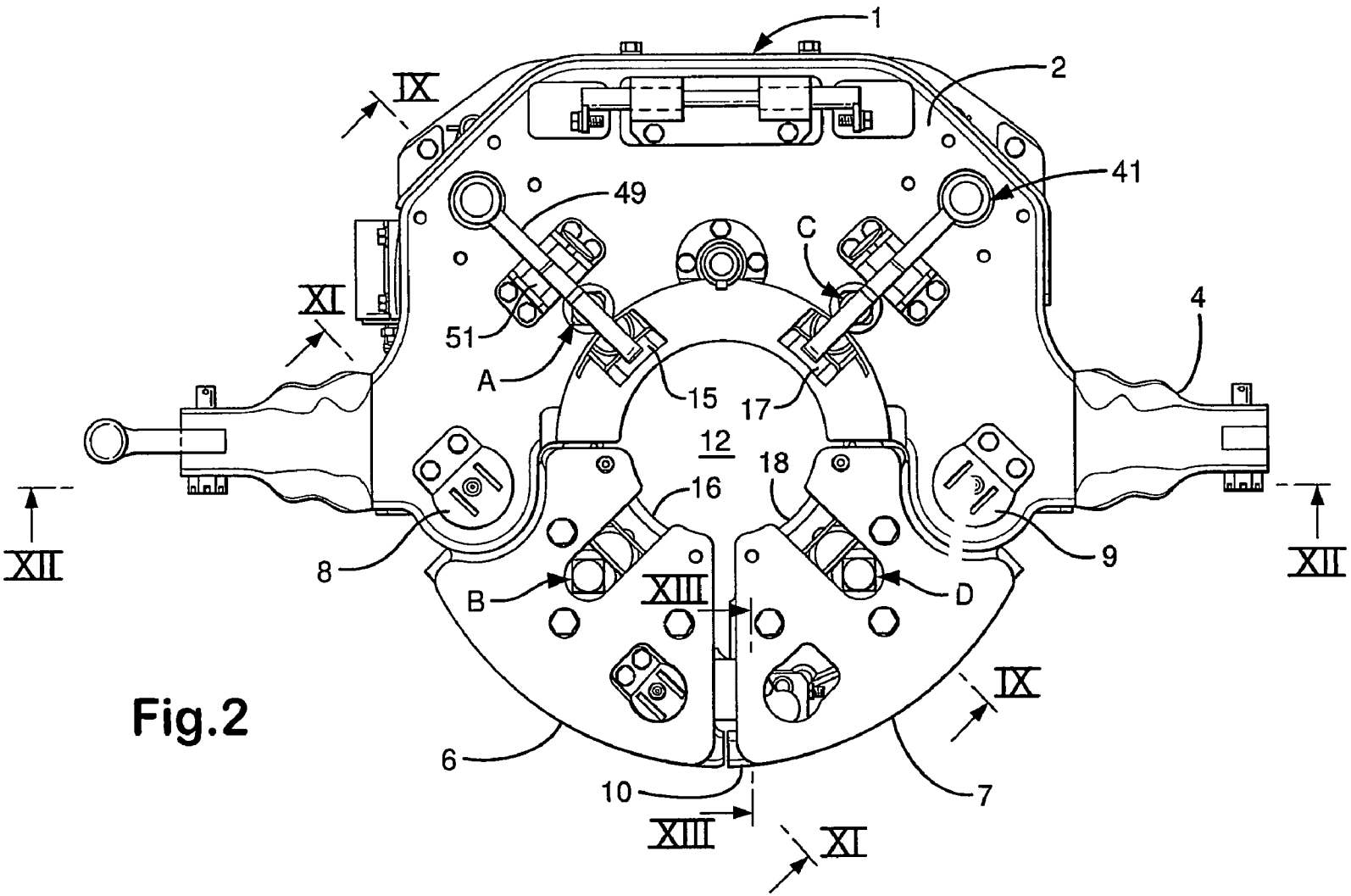
FIG. 2 is a top plan view of the apparatus shown in FIG. 1, with a cover plate removed.
Figure 9:
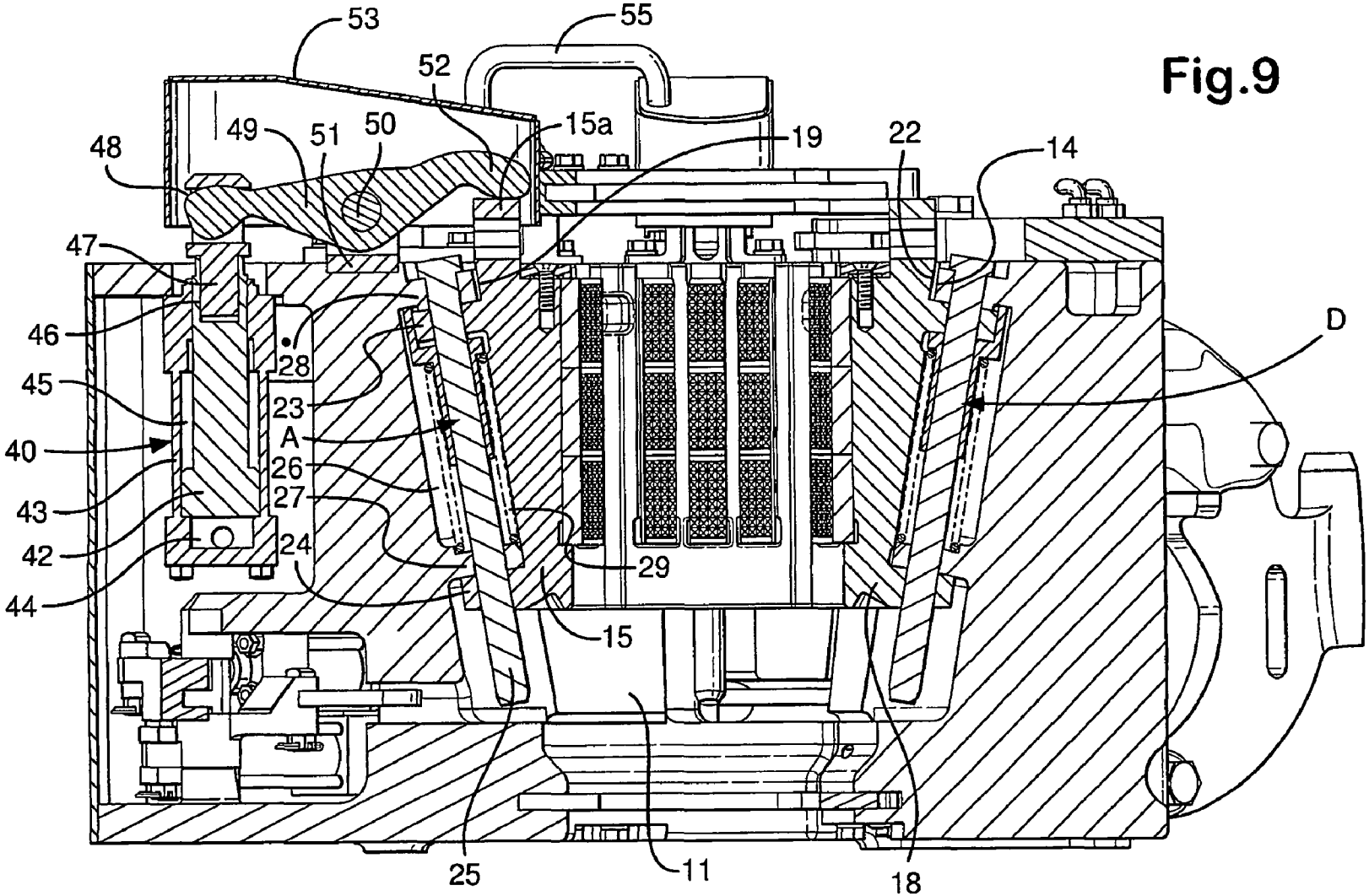
FIG. 9 is a cross-sectional view of the apparatus shown in FIG. 1 taken along the line IX-IX of FIG. 2.

As can be seen from FIG. 2, four slips 15, 16, 17 and 18 are provided in and line the frusto-conical surfaces 11, 13 and 14. Each slip subtends slightly less than ninety degrees in their operating positions. Two of the slips 15 and 17 are arranged on the part frusto-conical inner-surface 11 of the body 2 and each of the other two slips 16 and 17 is arranged on each part of frusto-conical inner surfaces 13 and 14 of each door 6 and 7. Each slip 15 to 18 has a part frusto-conical outer surface 19 to 22, which substantially corresponds with the frusto-conical inner surfaces 11, 13 and 14, when the slips 15 to 18 are located in a set position. The slips 15 are moveable along the part frusto-conical inner surface 11 to selectively engage (set) and disengage (unset) a pipe (not shown) in the throat 12 of the elevator 1. The slips 15 to 18 are each provided with a mechanism A, B, C, D for maintaining the slips 15 to 18 in an unset position. Mechanism A will be described for slip 15, although it will be understood that the slips 16, 17 and 18 and the mechanisms therefore are generally similar. Referring to FIG. 9, in which slip 15 is shown in an unset position and FIG. 10 in which the slips 15 and 16 are removed, slip 15 has an upper lug 23 and a lower lug 24 located on a frusto-conical outer surface 19. The upper lug 23 and lower lug 24 are in vertical alignment and have holes, the centres of which align with a line parallel to the part frusto-conical outer wall 19. The upper lug 23 and lower lug 24 are slidably arranged on a pin 25. The pin 25 is arranged in a recess 26 in the part frusto-conical inner surface 11 and lies substantially parallel therewith and is retained in a hole in a lower projection 27 and in a hole in an upper projection 28 of the body 2. The lower lug 24 of the slip 15 is arranged on the pin 25 beneath the projection 27 and the upper lug 23 of the slip 15 is arranged between the lower and upper projections 27 and 28. A spring 29 is arranged about the pin 25 and a sleeve 30 between the lower projection 27 and a lip 31 on the upper end of the sleeve 30 on which upper lug 23 seats.

The sleeve 30 has a back portion 32, the top of which sits against the bottom of a small groove 32*a*. The spring 29 biases the back portion 32 of the sleeve 30 against the bottom of the small groove 32. The back portion 32, the upper projection 27 and the lip 31 define an opening and the distance between the upper projection 27 and the lip 31 is slightly larger than the upper lug 23', such that the upper lug can slide into and out of the opening.

The spring force in the coiled spring 29 is greater than the weight of the slip, thus the spring 29 maintains the slip 15 in a raised, unset, disengaged position.

The pin 25 is slideably removable from the hole in the lower projection 27, through the spring 29, sleeve 30 and upper projection 28. By removing the pin 25, the slip 15 can be removed and changed for a different slip of the same type or size, or a slip of a different size suitable for handling pipe of a different diameter or a pipe of a different kind, such as premium tubular, which might require pipe engaging teeth of a different kind to reduce the possibility of damage to the surface of the tubular.

The pin 25 is then slid back through upper projection 28, sleeve 30, spring 29 and lower projection 27. The pin 25 may be threaded to threadedly engage the upper or lower lugs 27 and 28, or may have a smooth interference fit surface or may be a loose fit and may be prevent from falling out lugs 27 and 28 by a member lying over the top of the pin 25. Each slip 15 to 18 is provided with a top projection 15*a*, 17*a* and (not shown) with a hole therein to facilitate removal and replacement.

For an elevator 1 as described herein, the slips 15 to 18 can be exchanged for one of six different sizes for handling pipe sizes between 2⅜"-2⅞". For the first size set of slips, 2⅞"-3½" for the second size set of slips, 3½"-4½" for the third size set of slips, 4½"-5½" for the fourth size set of slips, 5⅝"-6⅝" for the fifth size set of slips and 6⅝"-7⅝" for the sixth size set of slips. The elevator 1 is preferably suitable for holding pipe string loads of 227 tonnes (250 short tons) and in other embodiments 454 tonnes (500 short tons), 681 tonnes (750 short tons) 907 tonnes (1000 short tons).

Figure 5:
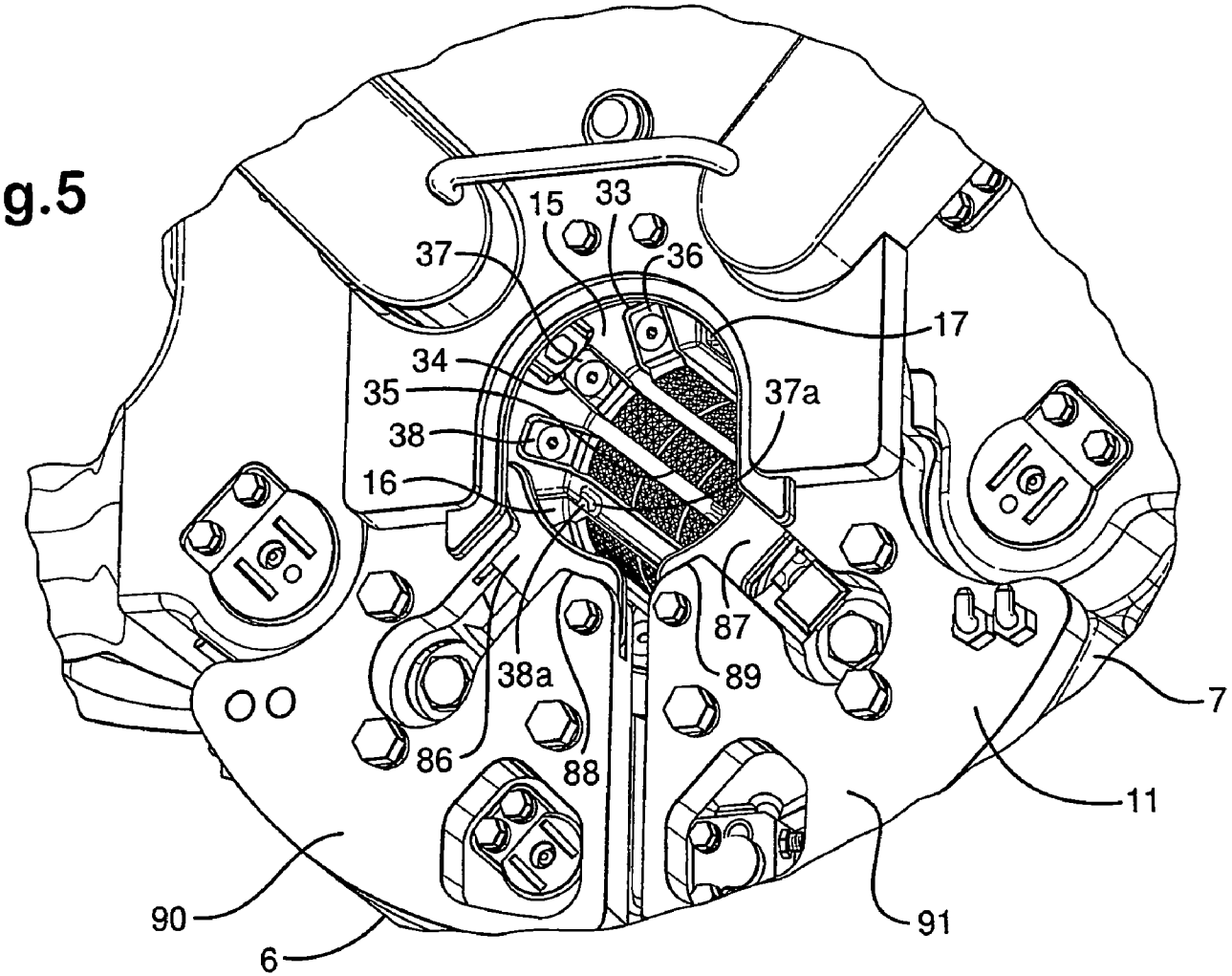
FIG. 5 is a fragmentary perspective view showing part of the top and centre of the apparatus shown in FIG. 1.

The slip 15 has a solid body, which may be made of any material suitable for resisting compression forces of in excess of 227 Tonnes (250 short tons) and in other embodiments 454 tonnes (500 short tons), 681 tonnes (750 short tons) 907 tonnes (1000 short tons) or more. The solid body has three grooves 33, 34, 35 therein running from top to bottom, as shown in FIG. 5. The grooves 33, 34, 35 converge towards the lower end. Inserts 36, 37, 38 which correspondingly converge towards a lower end, are slid into corresponding grooves 33, 34, 35. The inserts have a pipe engaging surface 39, which may be any suitable finish or material, such as tungsten carbide particles, diamond particles, metallic teeth, or any material which resists slippage.

The slip 15 also has a recess 37*a* in one side of the slip for receiving a corresponding upstand 38*a* on adjacent slip 16. Slip 17 has a corresponding upstand (not shown) on the opposing side of the slip 17 to fit into a corresponding recess (not shown) in slip 18. The upstand 38*a* is tapered and the recess 37*a* is correspondingly tapered, although in another embodiment, both the upstand 38*a* and the recess 37 may not be provided with tapers. Each slip 15 to 18 may thus be provided with an upstand and a corresponding recess, such that when fitted together, downward force can be transmitted through the upstand and recesses to adjacent slips, so that a setting force can be applied to one slip to transmit the setting force through the upstand and recesses to set one further or all the slips 15 to 18 simultaneously on a pipe. The upstand 38*a* and recess 37*a* allow a radial movement therebetween such that the slips can move apart when being moved up into an unset position along the part frusto-conical inner surfaces 11, 13 and 14 and move together when the slips are moved down the part frusto-conical inner surfaces 11, 13 and 14 into the set position, whilst still able to transmit the downward forces between the slips required to set the slips on a pipe. Preferably, the upstand 38*a* and corresponding recess 37*a* have an interference fit. Thus the slips interengage to transmit longitudinal force, whilst retaining the ability to radially contract and expand between one another.

The slips 15 to 18 are set using a slip activation mechanism. The slip activation mechanism comprises two slips actuating mechanisms 40 and 41 which are generally similar to one another, one located on the left side of the body 2 and the other on the right side of body 2.

Slips actuating mechanism 40 will be described for activating slips 15 and 16, although it will be understood that the slips actuating mechanism 41 is generally similar for activating slips 17 and 18. Slips actuating mechanism 40 comprises piston 42 and a cylinder 43 defining a chamber 44 and an annulus 45. The hydraulic fluid contact area on the piston provided by the annulus 45 is approximately the same as the hydraulic fluid contact area on the piston provided by the chamber 44. A recess 46 is located in the top of the piston 42 for slideably receiving a pin 47. The pin 47 has a hole 48 therein transverse to the length of the pin 47 for receiving a lever 49. The lever 49 is rotatably arranged on a substantially horizontally disposed pin 50 on a lug 51 fixed to the body 2. The lever 49 is shaped so that there is a defined distance between the lever 49 and the body 2 to limit the vertical travel of the lever 49. The lever 49 has an integral finger portion 52 which lies above part frusto-conical inner surface 11 and above top projection 15*a* of the slip 15, when there is a slip 15 in the elevator 1. Upon activation of the slips actuating mechanism 40, hydraulic pressure is increased in chamber 44 causing hydraulic fluid to flow into chamber 44 and inducing upward movement of the piston 42 and hydraulic fluid to flow out of annulus 45. The pin 47 is pushed up with the piston 42, which moves lever 49 upwardly about the pin 50 and thus finger 52 downwardly on to the top of the slip 15 to provide a setting force which compresses the spring 29 of mechanism A and the spring (not shown) of mechanism B by transfer of the setting force through the projection 38*a* and recess 37*a* to engage a pipe (not shown). The hydraulic actuating mechanism 41 is actuated in a similar way to set slips 17 and 18. All slips 15 to 18 are set simultaneously on the pipe. The hydraulic force provided by the slips actuating mechanisms 40 and 41 is preferably sufficient to cause the pipe engaging surface 39 of the slip 15 to bite into the wall of the pipe. The elevator 1 is lifted on the bails 5 and the weight of the pipe causes the pipe further engage surfaces 39 of the slips 15 to bite into the surface of the pipe. The hydraulic actuating mechanism transfers approximately 4.5 tonnes (five short tons) of setting force to the slips 15 to 18. The hydraulic pressure is maintained during the handling of the pipe to inhibit the pipe from disengaging, even if there is an upward force of about 4.5 tonnes (five short tons) of upward force applied to the pipe.

The spring force on each spring 29 is approximately 300N to 500N sufficient to hold a slip in the raised, unset condition. The slips 15 to 18 weigh in one embodiment between ICON and 300N each, i.e. the spring force of each spring is greater than the weight of each slip 15 to 18, so that the spring 29 will maintain the slip is a raised, unset, disengaged position.

Hydraulic pressure may be increased in the annulus 45 and/or decreased in the chamber 44 to retract the piston 42. This allows the pin 47 to fall back into the recess 46 and the lever to rotate about pin 50 to lift the finger 52 out of engagement with the top projection 15*a* of the slip 15. Due to the weight of the pipe being greater than the spring force provided by the springs 29 and the corresponding springs in mechanisms B, C and D, the slips 15 to 18 will maintain a grip on the pipe until a upward force is exerted to sufficiently reduce the effective weight of the pipe, which will disengage the pipe engaging surface 39 of the slips 15 to 18 which will allow the spring 29 and the springs of the mechanism B, C and D to expand to return the slips 15 and 18 to a raised, unset, disengaged position. Such an upward force on the pipe may be provided by the pipe having been stabbed and connected to a pipe string, the pipe string being held in a spider, thus the weight of the pipe is taken by the drill string which allows the springs 29 to lift the slips out of engagement with the pipe. Further lowering of the elevator 1 would help disengage the slips 15 to 18, but this would only be required occasionally or in exceptional circumstances.

Referring back to FIG. 1, a cover 53 is provided to protect the slips actuating mechanisms 40 and 41 from being knocked or clogged with dirt, drilling mud and debris. The cover is hinged on a hinge 54 and a handle 55 is provided for lifting the cover to gain access to the actuating mechanisms 40 and 41 and to mechanisms A and C.

The cover 53 also has a U-shaped cut out 56 and a plastics material or metal buffer, preferably a soft ductile metal buffer 57, which acts as a pipe guide to facilitate locating a pipe in the throat 12 of the elevator 1.

A pipe to be handled is offered up to the elevator 1 when the doors 6 and 7 of the elevator 1 are open.

Figure 3:
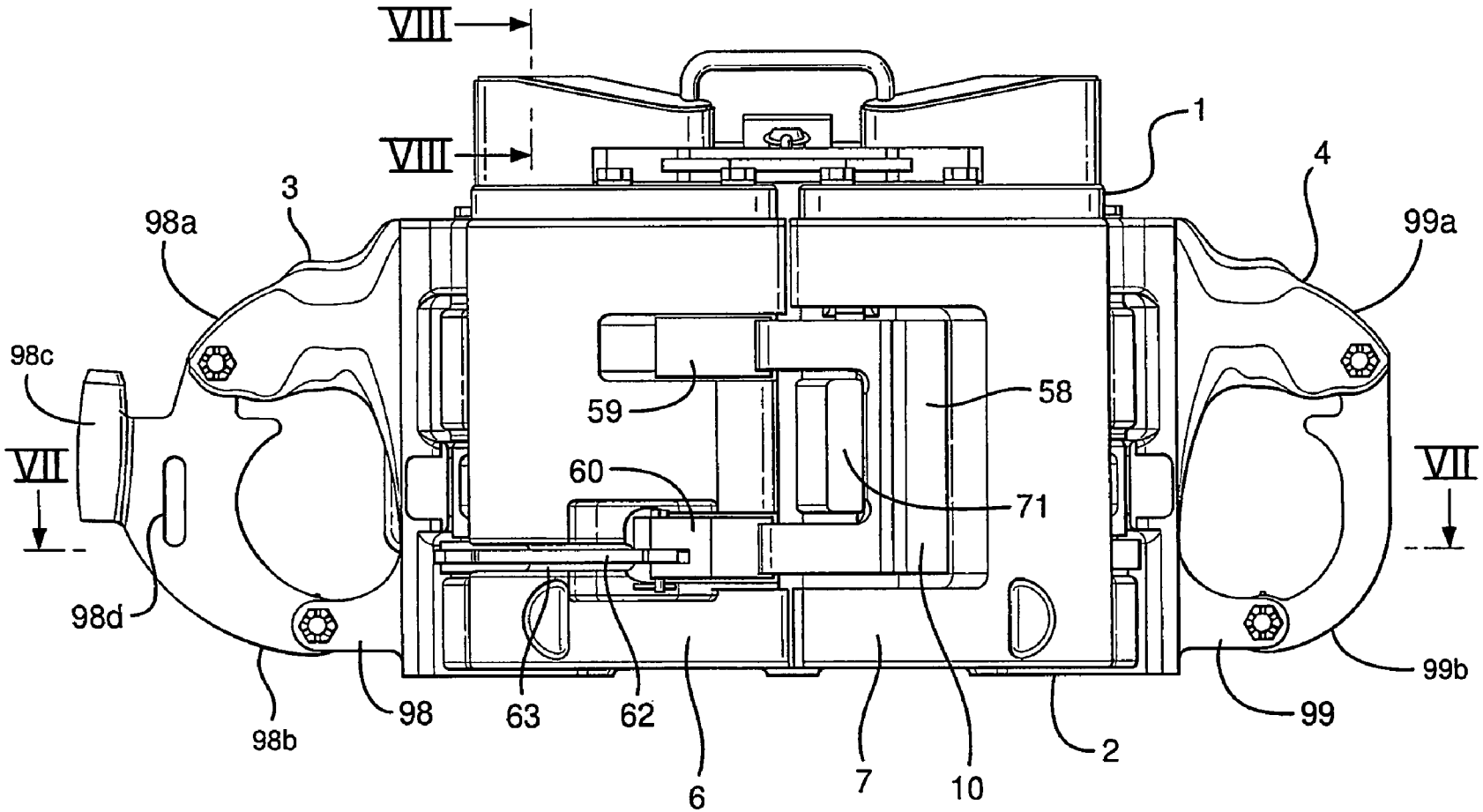
FIG. 3 is a front view of the apparatus shown in FIG. 1.
Figure 7:
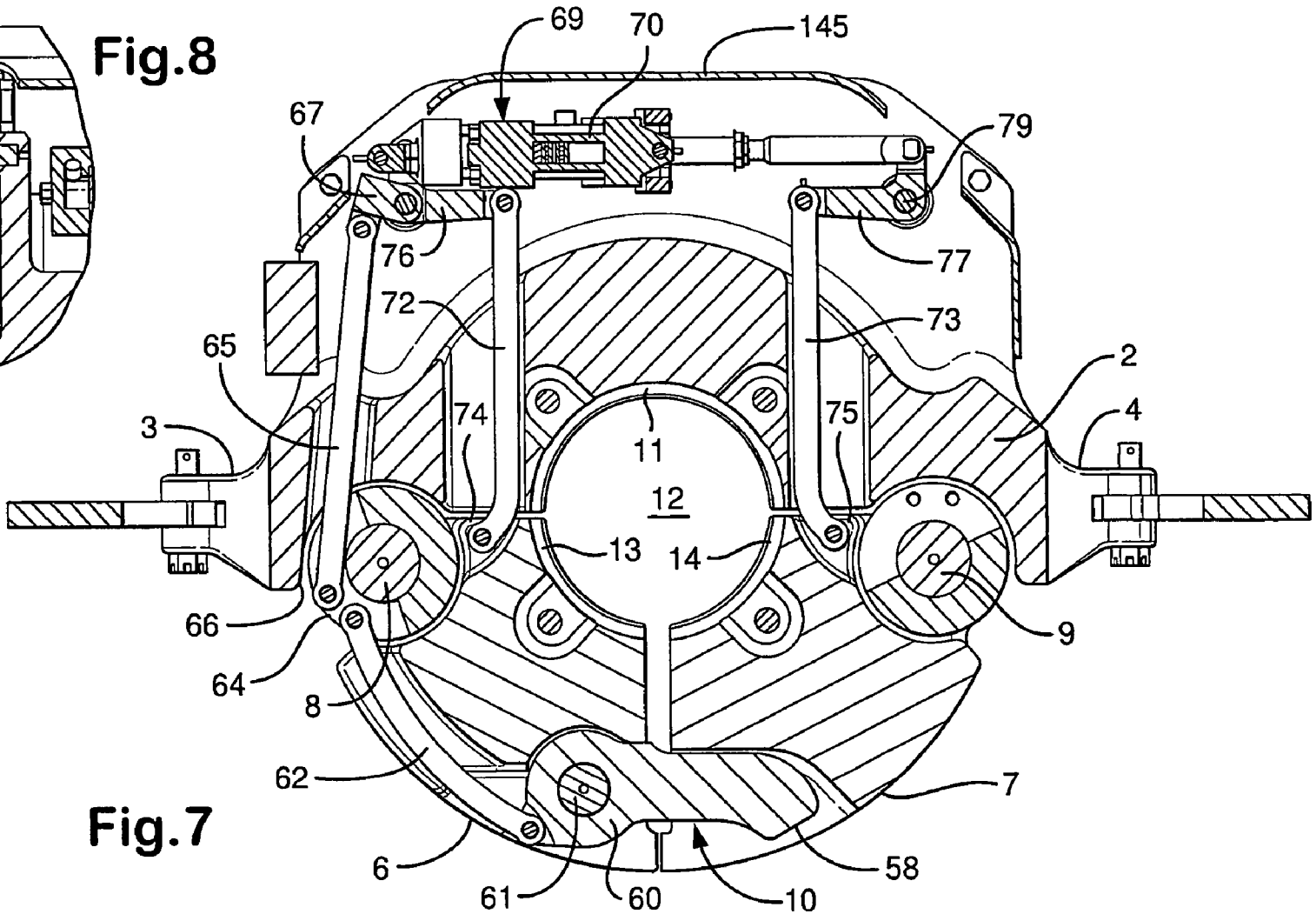
FIG. 7 is a cross-sectional view of the apparatus shown in FIG. 1, taken along the line VII-VII of FIG. 3, with the slips removed.
Figure 8:
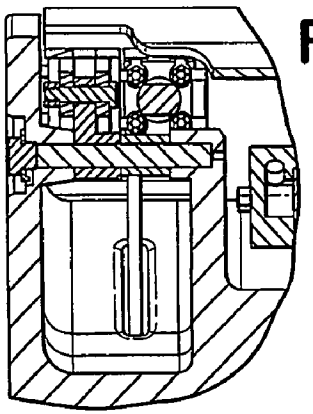
FIG. 8 is a fragmentary cross-sectional view of the apparatus shown in FIG. 1 taken along line VIII-VIII of FIG. 3.

Referring to FIGS. 3 and 7, to open the doors 6 and 7, the latch 10 is released. The latch 10 comprises a locking bar 58 on upper and lower arms 59 and 60 which are hinged with a hinge pin 61 to door 6. A curved linkage arm 62 is located in a recess 63 in the door 6.

Figure 4:
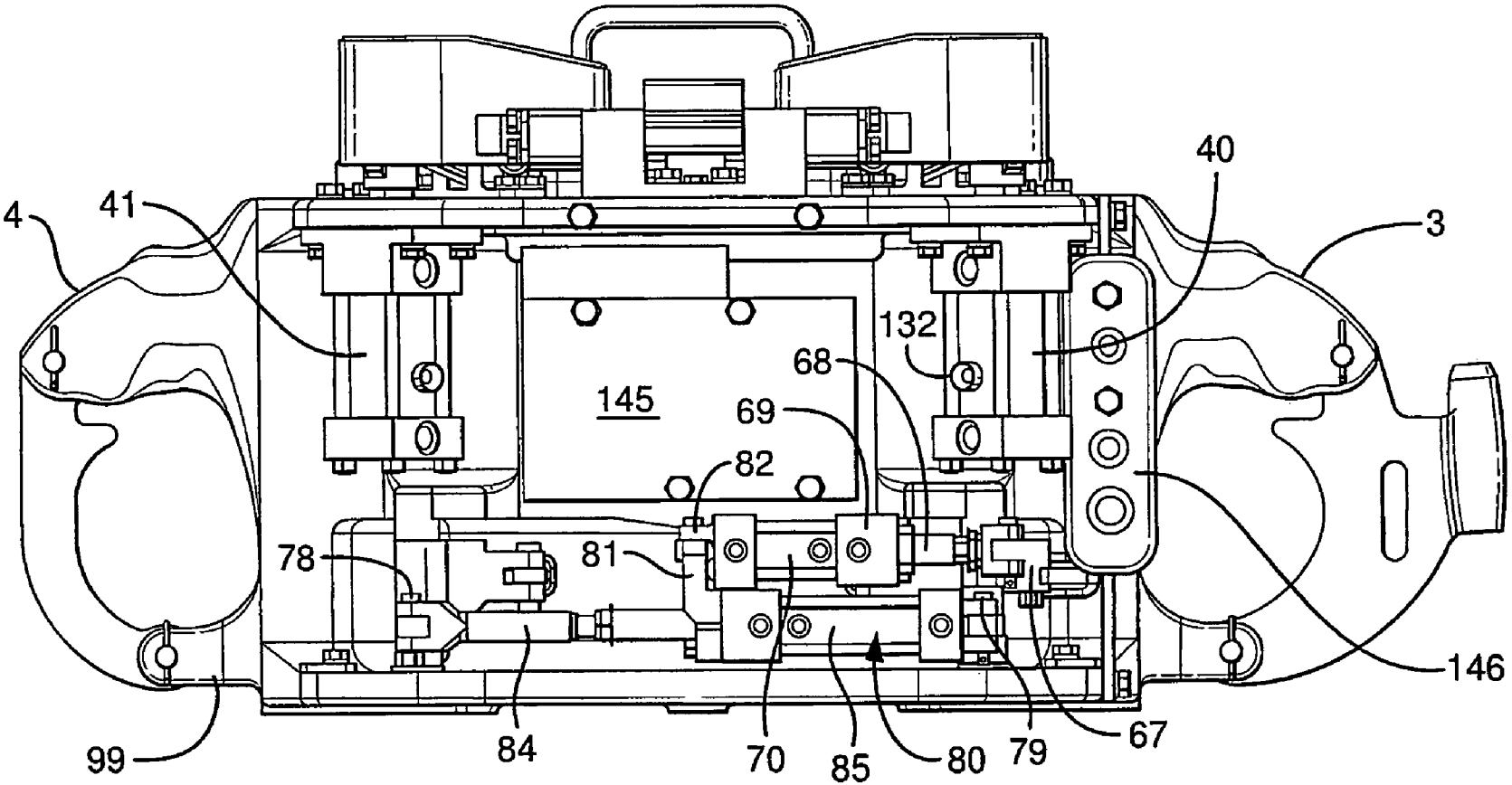
FIG. 4 is a back view of the apparatus shown in FIG. 1.

The curved linkage arm 62 has two opposed ends, one end linked to the lower arm 60, off-centre from the hinge pin 61 and the other end to a bearing 64 freely rotatable around hinge pin 8 of door 6. A further linkage arm 65 is located in an opening 66 in the body 2 of the elevator 1 extending from the front of the elevator 1 to the back of the elevator 1 past the lifting ear 3. The further linkage arm 65 has two opposed ends one linked to the bearing 64 and the other to an elbow linkage 67 which is linked to a piston 68 of a double acting piston and cylinder 69, as shown in FIG. 4. Upon hydraulic fluid pressure increasing in an annulus 68*a* behind the piston 68 in the cylinder 68 and/or decreasing in a chamber 68*b* in front of the piston 68, the piston 68 retracts pulling elbow linkage 67 and linkage arm 65 to rotate bearing 64 and pull the curved linkage arm 62 to rotate the latch 10 about the hinge pin 61 to unlatch the latching locking bar 58 from engagement with a catch 71 on the door 7.

The doors 6 and 7 are then opened. Linkage arms 72 and 73 each have two opposed ends and are arranged in openings which pass from the front to the back of elevator 1. One end of the linkage arm 72 and 73 is located in a recess 74 and 75 and attached to their respective doors 6 and 7 at a point which is offset from the hinge pins 8 and 9. The other end of each linkage arms 72 and 73 is attached to an elbow linkage 76 and 77 respectively, which are rotatable about pins 78 and 79.

The other end of elbow linkages 76 and 77 are attached to piston and cylinder 80. An upstand 81 is slideably arranged in fingers 82 to allow the piton and cylinder 80 to move longitudinally. Upon hydraulic fluid pressure increasing in an annulus 83 behind the piston head, the piston 84 retracts into the cylinder 85 which pulls the ends of elbow linkages 76 and 77 to rotate the elbow linkages about pins 78 and 79, which transfer a the pulling force into a pushing force on linkage arms 72 and 73 to open the doors 6 and 7.

A pipe is swung into or offered up to, or the elevator 1 is offered up to the pipe, through the open doors 6 and 7 into the throat 12 of the elevator 1 and abuts the buffer 57 of the pipe guide arranged in the U-shaped cut-out 56 in the cover 53. The doors 6 and 7 are closed by raising the pressure in a chamber 86 and/or lowering the pressure of the hydraulic fluid in the annulus 83 of piston and cylinder 80, which extends the piston 84 and moves the piston 84 to the left when referring to FIG. 4 and the cylinder 85 moves to the right, both the piston 84 and cylinder 85 moving longitudinally, which pushes the ends of elbow linkages 76 and 77 to rotate the elbow linkages about pins 78 and 79, which transfers the pushing force into a pulling force on linkage arms 72 and 73 to close the doors 6 and 7 about the pipe. As shown in FIG. 5, plastics material or metal, preferably a soft ductile metal, buffers 86 and 87 is provided on the edge of a curved cut-out 88 and 89 on cover plates 90 and 91 located on the top surface of the doors 6 and 7. The buffers 86 and 87 act as a pipe guide to facilitate the locating a pipe into the throat 12 of the elevator 1 upon closing the doors 6 and 7. The buffers 86 and 87 are bolted to cover plates 90 and 91.

Figure 6:
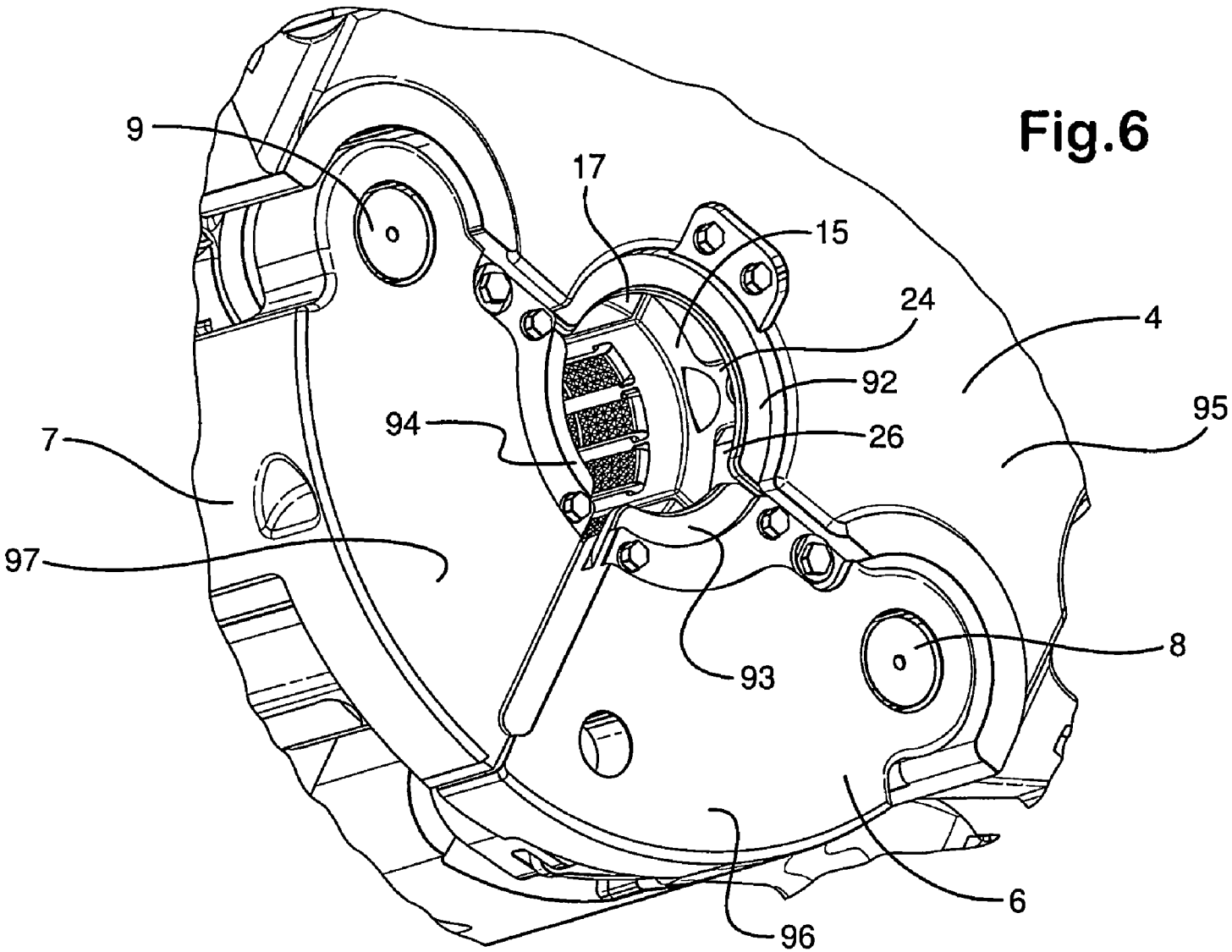
FIG. 6 is a fragmentary perspective view showing parts of the underside and front of the apparatus shown in FIG. 1.

Buffers 92, 93 and 94 are provided on the underside of the elevator 1 in cover plates 95, 96 and 97, as shown in FIG. 6.

The doors 6 and 7 take a substantial portion of the weight of the pipe and are thus built to withstand 227 tonnes (250 short tons) of force and in other embodiments 454 tonnes (500 short tons), 681 tonnes (750 short tons) and 907 tonnes (1000 short tons). The latch maintains the doors 6 and 7 closed, and thus must be substantial and withstand the spreading force of the slips as they engage the pipe. The latch 10 is built to withstand 227 tonnes (250 short tons) of force and in other embodiments 454 tonnes (500 short tons), 681 tonnes (750 short tons) and 907 tonnes (1000 short tons) in tension between the doors 6 and 7.

Figure 17:
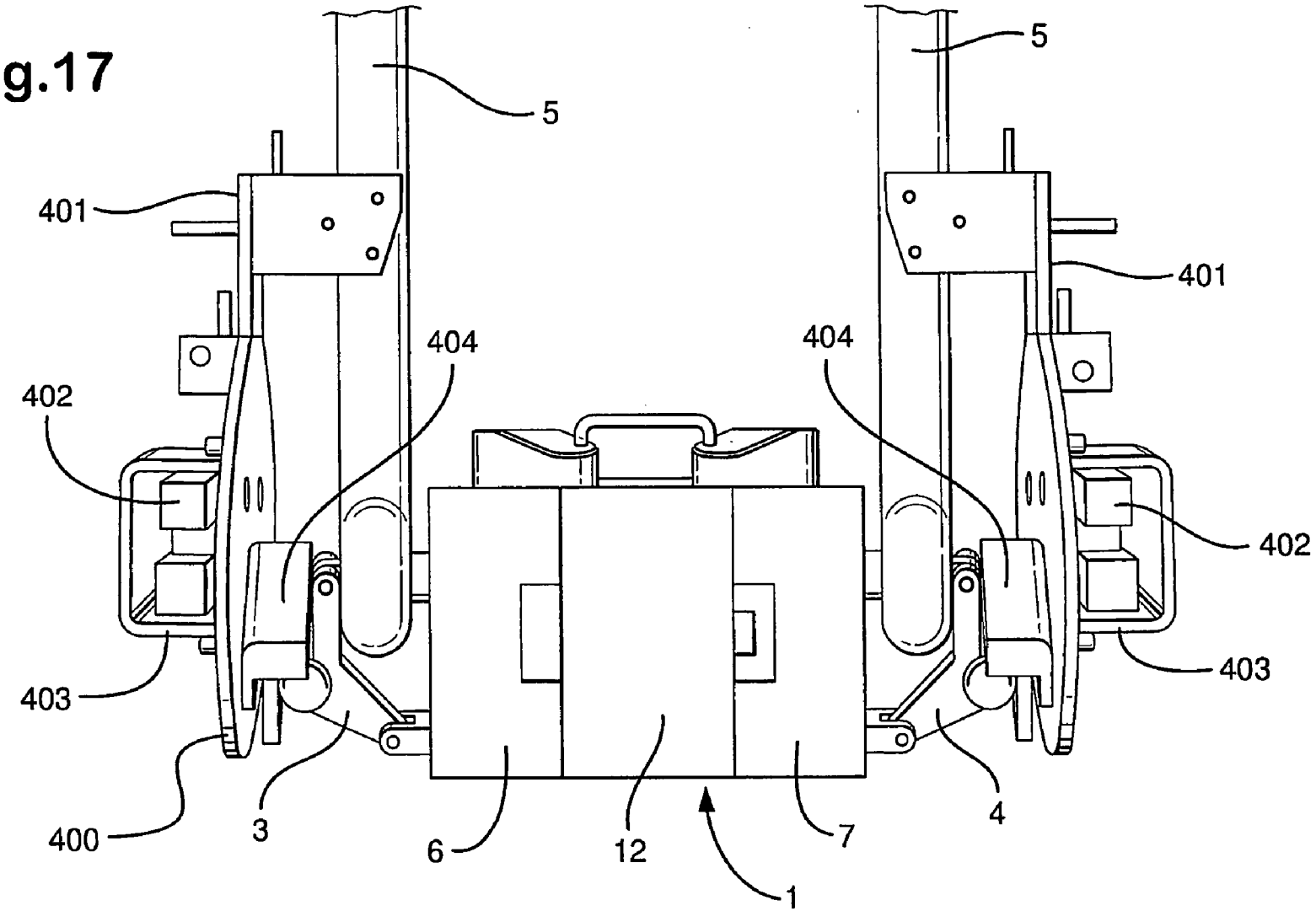
FIG. 17 is a schematic representation of an apparatus shown in FIG. 1 depending from a pair of bails, the apparatus provided with a device for adjusting the orientation of the apparatus.

Referring to FIG. 3, the lifting ears 3 and 4 comprise lower lugs 98 and 99 and upper shoulder 98*a* and 99*a* integral with or welded to the body 2. Curved locking arms 98*b* and 99*b* are attached at either ends with pins, so that the curved locking arms 98*b* and 99*b* can be removed. Curved locking arm 98*b* has an integral lug 98*c* and a slot 99*d* therein for receiving a mechanism for tilting the elevator whilst attached to the bails 5 of a top drive (not shown). The tilting mechanism is sold by BJVarco and is used in conjunction with the state of art BX elevator currently available. Such an arrangement is shown in FIG. 17.

Figure 15:
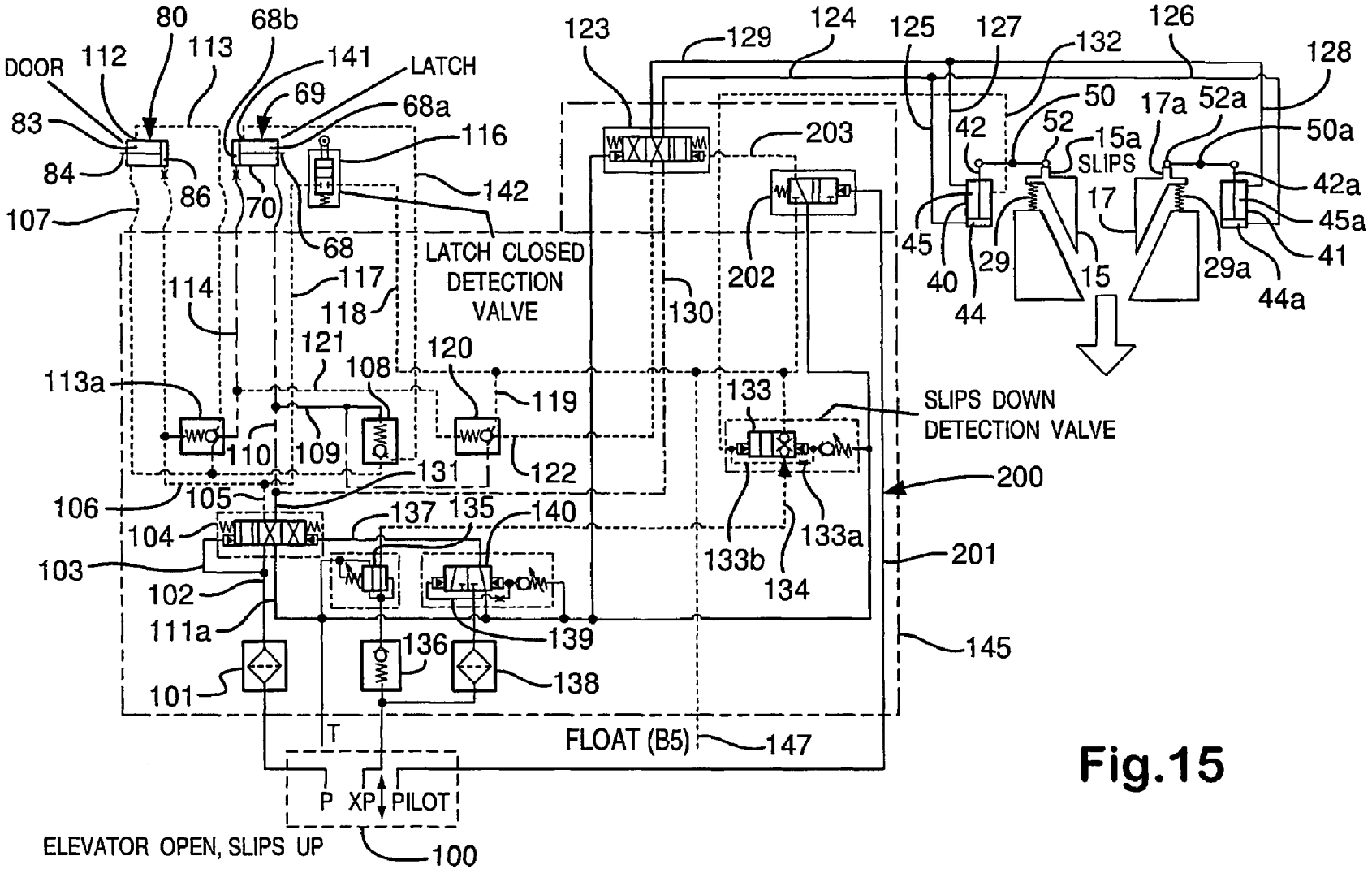
FIG. 15 is a schematic diagram showing a hydraulic circuit used in the apparatus shown in FIG. 1.

A hydraulic system is provided for controlling the operation of the elevator 1. The hydraulic system is shown schematically in FIG. 15, which shows the system in a state in which the slips are retracted, disengaged, unset and the latch and doors are open. An operator controls the hydraulic system from a control console 100 in an operator's cabin (not shown). Hydraulic fluid flows through the system at between 7.5 and 20 litres per minute (2 to 5 gallons per minute) and is supplied whilst the elevator 1 is being operated.

To close the doors 6 and 7, latch 10 and set the slips 15 to 18, the following steps are taken. Using the control panel 100, an operator operates a system valve (not shown) to set the hydraulic pressure in line P to a high pressure of between 124 to 159 bars (1800 to 2300 psi) and leaves the hydraulic pressure in line XP at atmospheric pressure. The hydraulic fluid passes in line P through a filter 101. The increase in pressure in the hydraulic fluid passes through line 102 and into control line 103 which shifts slide valve 104 to allow the increase in hydraulic pressure to pass from line 102 to line 105 and into line 106. Chamber 86 of door piston and cylinder 80 shifts the piston 84 into an extended position, closing the doors 6 and 7. Fluid is forced out of the annulus 83 into line 107 through check valve 108 into line 109 and into line 110 and through slide valve 104 and into line 111 and into line T. When the piston head of piston 84 passes a signal port 112, high pressure from line 106 communicates therewith and applies high pressure hydraulic fluid in signal line 113, which opens check valve 113*a* and allows hydraulic fluid at a high pressure to pass from line 106 across the check valve 113*a* to line 114 into the chamber 68*b* of the latch piston and cylinder 69. The build up of high pressure hydraulic fluid in chamber 68*b* pushes on piston head of piston 68 to move the piston 68 into an extended position closing the latch 10.

A latch detection valve 116 is located between the latch 10 and the door 7, such that upon closing of the latch 10, the latch detection valve 116 shifts to allow high pressure hydraulic fluid to pass thereacross between line 117, which is in fluid communication with line 105, and signal line 118. High pressure hydraulic fluid in signal line 118 passes into signal line 119 opening the check valve 120, allowing high pressure hydraulic fluid to pass across check valve 120 between line 121, which is in fluid communication with line 114, and line 122. High pressure hydraulic fluid flows on from line 122 through slide valve 123 into line 124 into lines 125 and 126 and into chambers 44 and 44*a* of slip actuating mechanism, piston and cylinders 40 and 41, which shift the pistons 42 and 42*a* into extended positions moving fingers 52 and 52*a* downwardly on to the slips 15 and 17 against springs 29 and 29*a* to set the slips 15 to 18 on a pipe (not shown). The slips 15 to 18 are set with a hydraulic power down force of approximately 4.5 tonnes (5 short tons), which is enough to create an initial penetration of the teeth of a standard set of inserts located on the slips 15 to 18 into a wall of the pipe, inhibiting the pipe from slipping through the slips 15 to 18 and allowing the buildup of the downward hoist load. The hydraulic fluid in the annuli 45 and 45*a* is squeezed into lines 127, 128 and into line 129, through slide valve 123 into line 130 into line 131, through slide valve 104, through line 111 and out into line T. When the piston 41 is in an extended position, which indicates the slips 15 to 18 are set, high pressure hydraulic fluid passes through signal line 132 to a slips down detection valve 133, which high pressure hydraulic fluid shifts the slips down detection valve 133 allowing high pressure 124 to 159 bars (1800 to 2300 psi) pneumatic fluid to communicate between signal line 118 and signal line 134. The slips down detection valve 132 will shift to be in fluid communication between signal lines 118 and 134 upon a pressure greater than 103 bars (1500 psi). The high pressure in the hydraulic fluid from line 118 passes into line 134 and through a pressure limiting valve 135, which limits the pressure flowing onwards to check valve 136 to approximately 69 bars (1000 psi), and into line XP with a pressure of approximately 69 bars (1000 psi) to indicate to the operator that the doors 6 and 7 are closed, the latch 10 is closed and the slips 15 to 18 are set. This is a step increase in pressure at XP from atmospheric to approximately 69 bars (1000 psi) which is easily noticeable by an operator. The slips down detection valve 133 will then return to its initial state by high pressure hydraulic fluid flowing through control line 133*b* through a restrictor 133*a*, which delays the onset of high pressure on the opposing side of the slips down detection valve 133. The spring force on the slips down detection valve returns the valve to its initial state in which it blocks fluid communication between signal lines 118 and 134.

Once the slips 15 to 18 are set, the elevator 1 is lifted and the weight of the pipe self-energises the slips 15 to 18, and thus are firmly held by the slips 15 to 18. If, for any reason, an upward force on the pipe occurs of up to 4.5 tonnes (5 short tons), the slips 15 to 18 will remain engaged due to the pistons 42 and 42*a* remaining in the extended position, which are held set by a force of at least 4.5 tonnes (5 short tons) of hydraulic force to the top of the slips. The high pressure hydraulic fluid is maintained at high pressure whilst the elevator 1 is in use. High pressure through line P is maintained throughout use of the elevator 1.

The slips 15 to 18 may be released whilst maintaining the doors 6 and 7 and latch 10 closed. This is accomplished using a slips activation system 200. The first step is to activate a PILOT valve (not shown) on the control panel 100 to allow, preferably 138 to 172 bars (2000 to 2500 psi) to flow through line 201 which activates slide valve 202, which requires a minimum of 103 bars (1500 psi) to operate to allow fluid communication between signal line 118 and line 203, which applies a high pressure to slide valve 123, shifting the valve to allow line 122 to communicate with line 129. The high pressure hydraulic fluid flows through lines 127 and 128 applying high pressure hydraulic fluid to annuli 45 and 45*a*, which retracts pistons 42 and 42*a* which allows the fingers 52 and 52*a* free to hinge about hinge points 50 and 50*a*. Hydraulic fluid in chambers 44 and 44*a* flows through lines 125, 126, through sliding valve 123 into line 130, through the line 131, through slide valve 104 into line 111 and into line T. The freely hinged fingers 52 and 52*a* allow the slips 15 to 18 to move to a retracted, disengaged, unset position on springs 29, 29*a* and (not shown), unless the weight of the pipe being held therein is not supported, in which case the slips 15 to 18 will remain engaged with the pipe due to the self-energising nature of the slips 15 to 18.

The latch 10 is opened and the doors 6 and 7 are then opened by maintaining the hydraulic pressure in line P at a high pressure of between 124 to 159 bars (1800 to 2300 psi) and operating XP valve (not shown) from the control panel 100 to allow hydraulic pressure of a greater pressure, preferably 14 bars (200 psi greater) i.e. between 138 to 172 bars (2000 to 2500 psi) to flow through line XP. The hydraulic fluid passes through the filter 101. The increase in pressure in the hydraulic fluid passes through line 102 and into control line 103, which pushes the valve 104, but is resisted and overcome by the pressure in line 137 applied by the pressure in line XP. The greater pressure in line XP flows through a filter 138 into a control line 139 which overcomes 103 bars (1500 psi) required to shift valve 140 to allow fluid communication between line XP and line 137. Hydraulic fluid at high pressure is allowed to flow from line 102 into line 131, line 110 and into the annulus 68*a* of the latch piston and cylinder 69 at a pressure of between 124 to 159 bar (1800-2300 psi), which causes the piston 68 to retract, unlatching the latch 10. The hydraulic fluid in chamber 68*b* is now at atmospheric pressure and flows through line 114 past check valve 113*a* into line 106, through slide valve 104, into line 111*a* and into line T.

Once the piston has retracted fully and thus unlatched the latch 10, the piston head passes a signal port 141.

High pressure hydraulic fluid is allowed to pass through signal port 141 and through signal line 142 to activate check valve 108 to allow high pressure hydraulic fluid to flow through from line 110, through line 109 across check valve 108 into line 107 and into annulus 83 of: the piston and cylinder 69 to retract the piston 84 to open the doors 6 and 7. Hydraulic fluid squeezed out of chamber 86 flows through line 106 through slide valve 104 into line 127 and out of line T.

It should be noted that slips activation system 200 can be activated at any time to release the fingers 52 and 52*a* from engagement with slips 15 and 17. This is particularly important for applications where it is needed to allow the pipe to be released and re-gripped.

The slips activation system 200 may be replaced by or complemented by a hydraulic circuit which activates the pistons 42 and 42*a* of slips piston and cylinders 40 and 41 to automatically retract upon applying the greater pressure to line XP for opening the latch 10 and the doors 6 and 7. This can be accomplished by having a link between the XP valve and the PILOT valve, so that on activating the XP valve, the PILOT valve is activates, but when the PILOT valve is activated, the XP isn't activated. The slips activation system 200 is an optional system and may not be required in certain applications.

Figure 11:
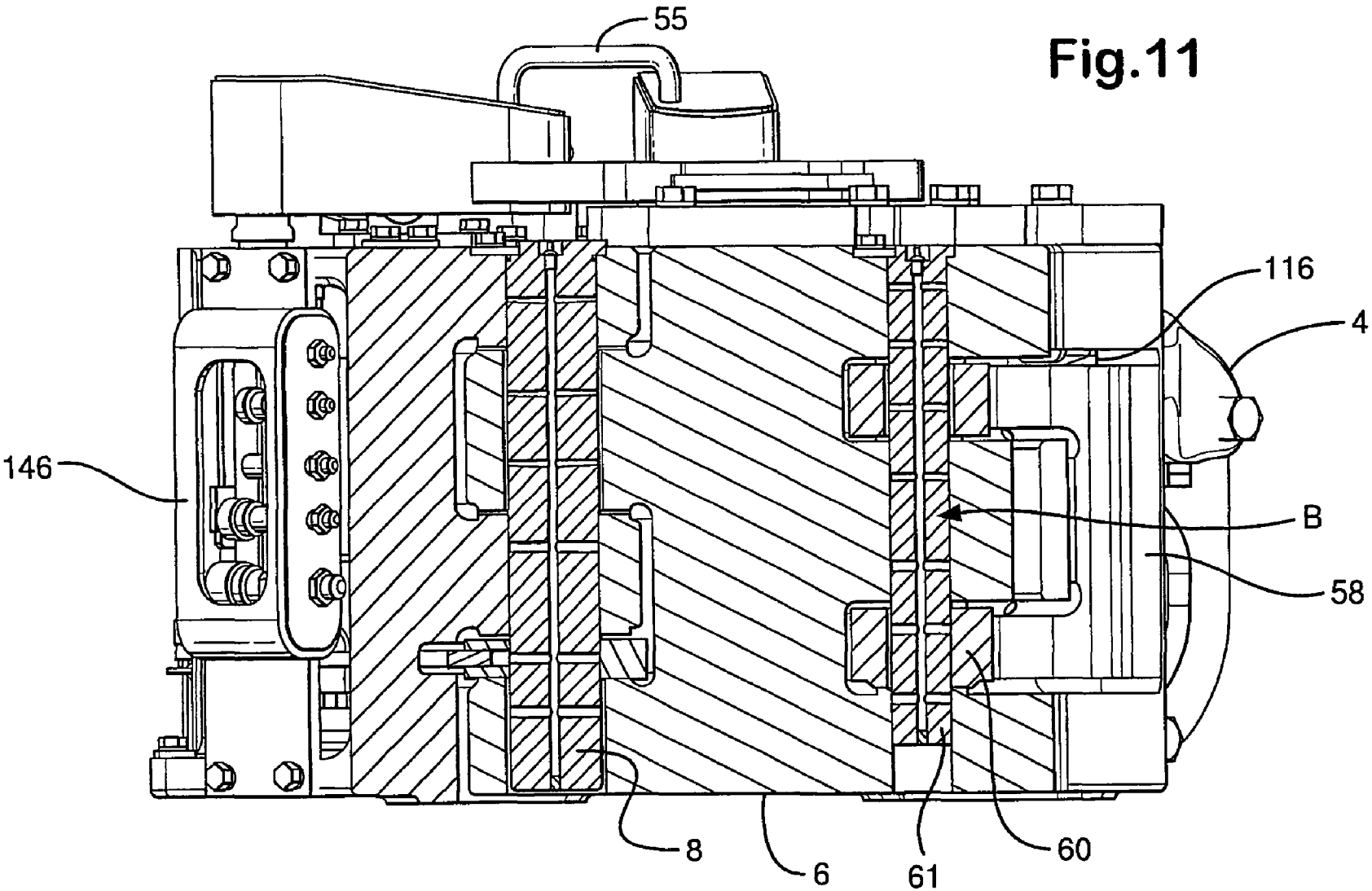
FIG. 11 is a cross-sectional view of the apparatus shown in FIG. 1 taken along the line IX-IX of FIG. 2.
Figure 12:
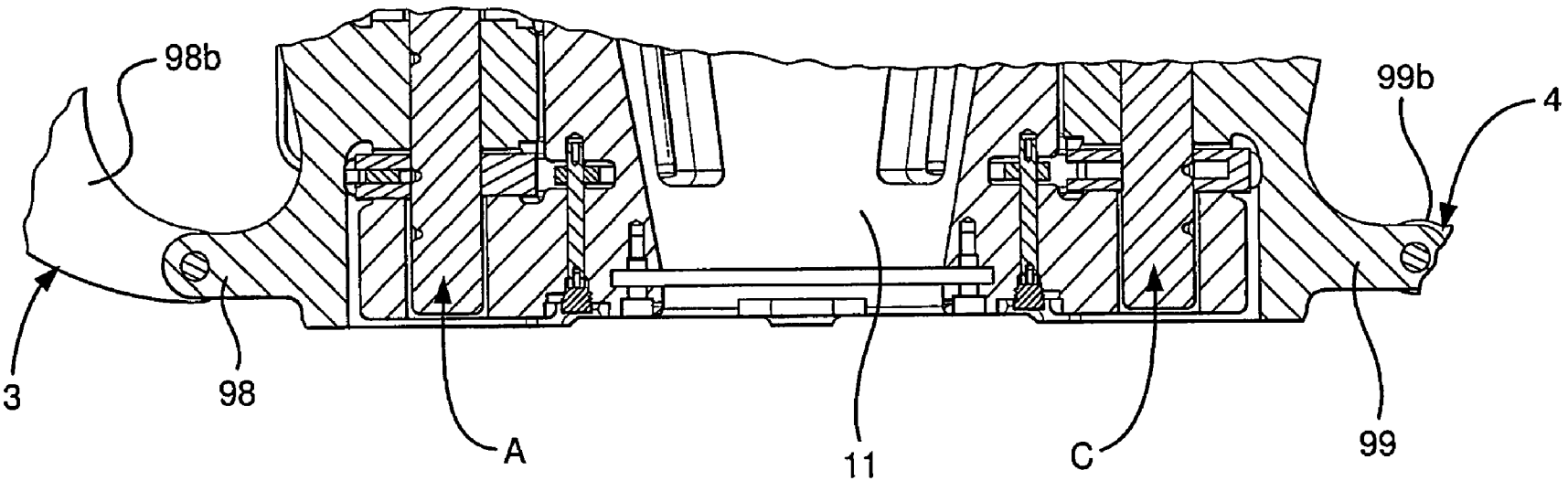
FIG. 12 is a fragmentary cross-sectional view of the apparatus shown in FIG. 1 taken along the line XII-XII of FIG. 2.
Figure 13:
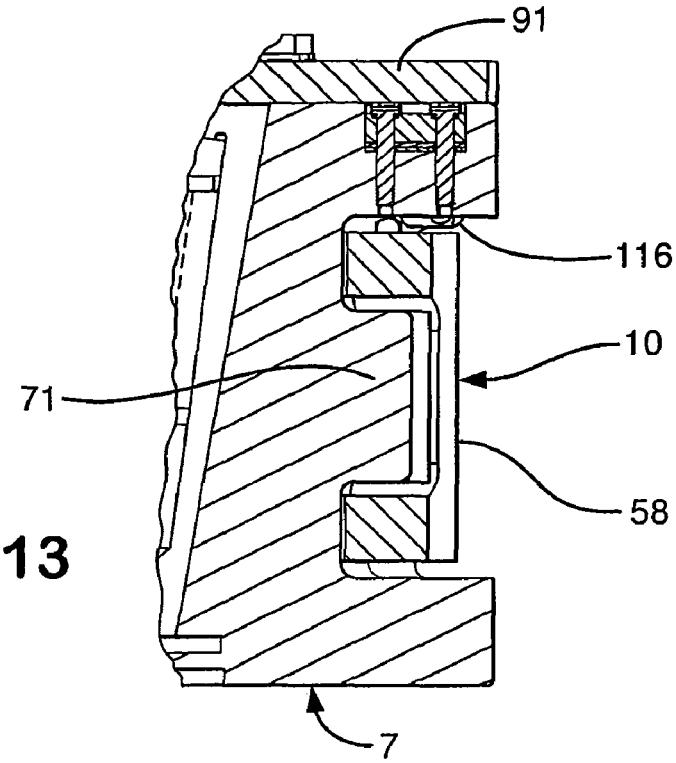
FIG. 13 is a fragmentary cross-sectional view of the apparatus shown in FIG. 1 taken along the line XIII-XIII of FIG. 2.

The hydraulic control circuit is housed in a box 145 located on the rear of the elevator 1, as shown in FIG. 4. A hydraulic control manifold 146, shown in FIG. 11 is provided on the elevator 1 for connecting the P line, T line, XP line, PILOT line and a FLOAT line 147 from the control panel 100 to the elevator 1. The hydraulic lines 144 connected to the manifold 146 may hang free or be bound into one umbilical and lead to a part of the derrick DR or to a top drive from which the elevator 1 may depend and onward to the control console 100 and to a source of hydraulic fluid and means for pressurizing the hydraulic fluid, which are commonly available on drilling rigs and platforms.

Figure 16:
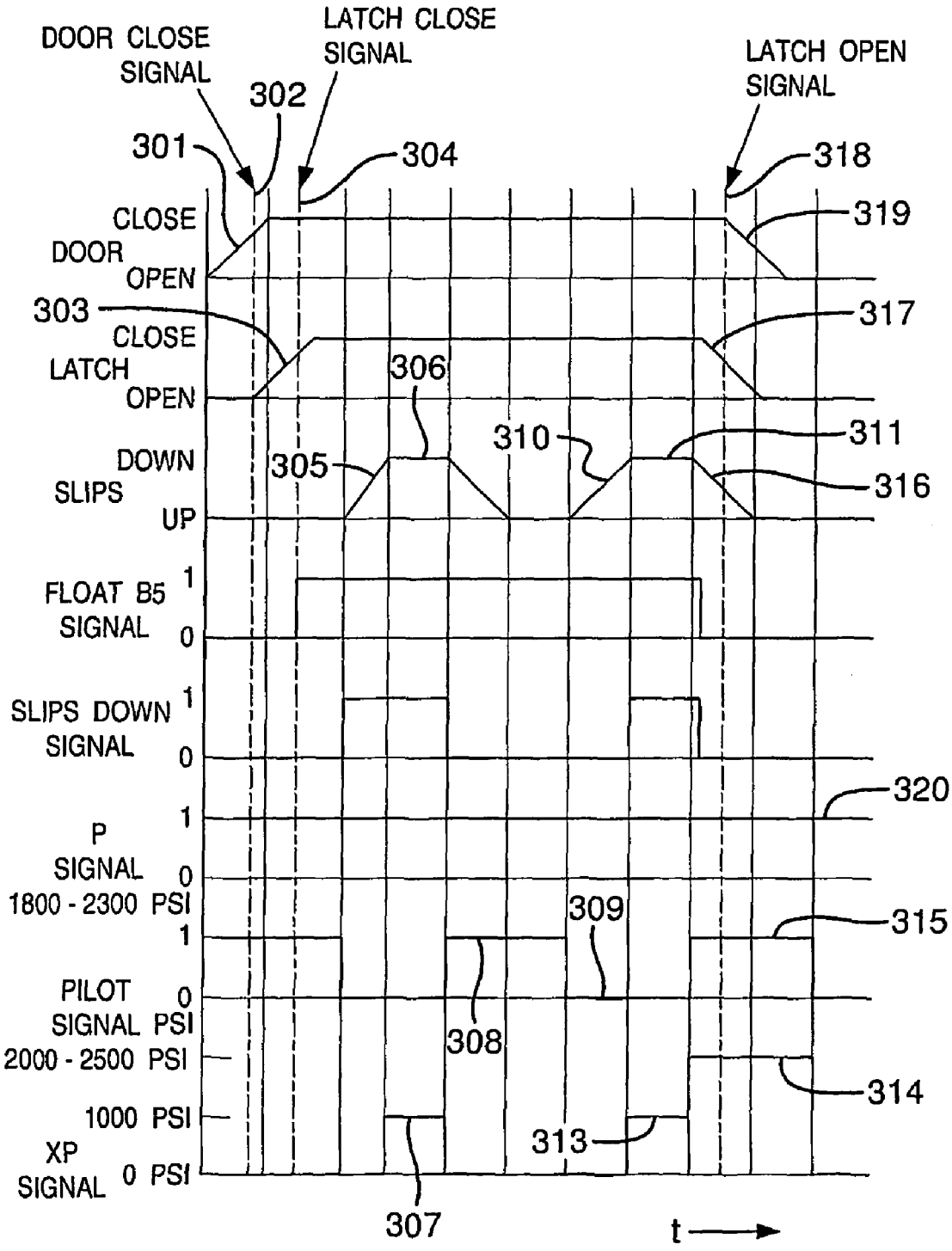
FIG. 16 is a graphical representation of steps in the operation of the hydraulic control circuit used to control the elevator shown in FIG. 1.

FIG. 16 shows a graphical representation of steps in the operation of the hydraulic control circuit against time, starting with the elevator 1 in an open position with a pipe in the throat 12 ready to be engaged and hoisted. The first step shown is the doors closing 301, when the doors are sufficiently closed, a signal 302 is sent to start the latch closing step 303. Once the latch is sufficiently closed, a signal 304 is sent to allow operation of the slips. The slips pistons 42 and 42*a* are extended 305 to set the slips. The slips are now set 306, and a signal 307 of 69 bar (1000 psi) is sent to the XP port to indicate to the operator that the slips 15 to 18 are set. A pressure 308 is applied to the PILOT line 201 to retract the pistons 42 and 42*a* for disengaging the slips 15 to 18. Pressure 308 of between 138 to 172 bars (2000 to 2500 psi) in the pilot line is moved to atmospheric 309, whereupon slips pistons 42 and 42*a* are extended 310 to set 311 the slips 15 to 18, and a signal 313 of 69 bar (1000 psi) is sent to the XP port to indicate to the operator that the slips 15 to 18 are set.

A greater pressure of 138 to 172 bars (2000 to 2500 psi) is applied 314 to port XP and a pressure of 138 to 172 bars (2000 to 2500 psi) is applied 315 to the PILOT line to retract 316 the slips and the opening sequence commences with latch 10 opening 317, whereupon a latch open signal 318 initiates door 6 and 7 opening 319. It should be noted that the pressure 320 in line P of between 124 to 159 bar (1800-2300 psi) is maintained throughout the operation.

Optionally, the elevator 1 can be tilted by a device 400, as shown in FIG. 17. The elevator 1 depends from bails 5. The device 400 comprises plates 401 rigidly secured to bails 5. The plates 401 each have a hydraulic motor 402 having a stator 403 fixed to the plates 401 and a rotor 404 attached to the ears 3 and 4 the elevator 1, so that upon activation of the rotors 404, the elevator 1 is tilted for receiving a pipe lying at an angle between horizontal and vertical through the doors 6 and 7 into the throat 12 of the elevator 1. This allows picking up pipe from or laying pipe down on the ramp leading to the opening in the derrick known as the V-door. Such a mechanism is used on the state of the art BX elevator sold by BJVarco. Preferably, the FLOAT line 147 is used in conjunction with a hydraulic system (not shown) for operating the device 400, for providing a signal to allow the hydraulic system for the device 400 to rotate only when the slips are down, latch 10 is unlatched and the doors 6 and 7 are open, to prevent the device 400 from being operated when the elevator has a pipe therein.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. 102 and satisfies the conditions for patentability in 102. The invention claimed herein is not obvious in accordance with 35 U.S.C. 103 and satisfies the conditions for patentability in 103. This specification and the claims that follow are in accordance with all of the requirements of 35 U.S.C. 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes

What is claimed is:

1. An apparatus for handling pipes, the apparatus comprising, a door engaging with a latch, the door operated by a hydraulic piston and cylinder, the piston and cylinder having a signal port, a body having a tapered surface and at least a first slip and a second slip slidable on the tapered surface, a slip actuator for setting said at least said first slip and said second slip, said first slip and said second slip having interengaging elements therebetween such that upon actuation of said slip actuator, said first slip is set and said second slip is set by the interengaging elements transferring the setting force from the slip actuator through said first slip to said second slip, and a pilot line and a valve for selectively directing flow of a hydraulic fluid to the signal port to activate the slip actuator to disengage the slips, thereby allowing the slips to be disengaged while the door and latch remain engaged.

2. The apparatus as claimed in claim 1 wherein the interengaging elements comprise an upstand and a recess.

3. The apparatus as claimed in claim 1 wherein said first and second slips each has a pipe engaging surface, a top, a bottom, a rear face and two sides.

4. The apparatus as claimed in claim 3 wherein said interengaging elements are located on or in at least one of said sides.

5. The apparatus as claimed in claim 4 wherein the rear face slides along said tapered surface of said body.

6. The apparatus as claimed in claim 1, wherein said slip actuator sets said at least first and second slips by moving the at least first and second slips down said tapered surface, wherein the interengaging elements allow lateral movement between the first and second slip.

7. The apparatus as claimed in claim 1, wherein the tapered surface comprises at least two tapered surfaces.

8. The apparatus as claimed in claim 1, wherein the tapered surface takes the form of a frusto-conical surface.

9. The apparatus as claimed in claim 8 wherein the frusto-conical surface is located on a main body and two doors.

10. The apparatus as claimed in claim 9 wherein one of said doors comprises a latch and the other of said doors comprises a catch.

11. The apparatus as claimed in claim 10 wherein the main body subtends substantially one hundred and eighty degrees and each of the doors subtends between seventy-five and ninety degrees.

12. The apparatus as claimed in claim 9 wherein said first slip is located on the tapered surface of said main body and said second slip is located on the tapered surface of one of said doors.

13. The apparatus as claimed in claim 1 further comprising a third slip and a fourth slip slidable on said tapered surface, said apparatus further comprising a further slip actuator for setting said at least third slip and said fourth slip, wherein said third slip and said fourth slip have interengaging elements therebetween such that upon actuation of said slip actuator, said third slip is set and said fourth slip is set by the interengaging elements transferring the setting force from the slip actuator through said third slip to said fourth slip.

14. The apparatus as claimed in claim 1 wherein said slip actuator is hydraulically actuable.

15. A method for setting slips in an apparatus for handling pipes, the apparatus for handling pipes comprising a door engaging with a latch, the door operated by a hydraulic piston and cylinder, the piston and cylinder having a signal port, a body having a tapered surface and at least a first slip and a second slip slidable on the tapered surface, the apparatus further comprising a slip actuator for setting said at least said first slip and said second slip characterized in that said first slip and said second slip have interengaging elements therebetween such that upon actuation of said slip actuator, said first slip is set and said second slip is set by the interengaging elements transferring the setting force from the slip actuator through said first slip to said second slip, and a pilot line and a valve for selectively directing flow of a hydraulic fluid to the signal port to activate the slip actuator to disengage the slips, thereby allowing the slips to be disengaged while the door and latch remain engaged the method comprising the steps of operating the slips actuating mechanism to apply a setting force to the first slip, whereupon the interengagement transfer elements transfer the setting force to the second slip, setting the first and second slips simultaneously.

* * * * *